United States Patent [19]

Nakamura et al.

[11] Patent Number: 5,035,988

[45] Date of Patent: Jul. 30, 1991

[54] SILVER HALIDE PHOTOGRAPHIC MATERIAL CONTAINING A YELLOW COUPLER AND A PHOSPHORUS COMPOUND AND COLOR IMAGE FORMING METHOD

[75] Inventors: Yoshisada Nakamura; Masakazu Morigaki; Yoshio Ishii; Kei Sakanoue, all of Kanagawa, Japan

[73] Assignee: Fuji Photo Film Co., Ltd., Kanagawa, Japan

[21] Appl. No.: 351,139

[22] Filed: May 12, 1989

[30] Foreign Application Priority Data

May 12, 1988 [JP] Japan ..... 63-115731
May 12, 1988 [JP] Japan ..... 63-115732
May 13, 1988 [JP] Japan ..... 63-117961

[51] Int. Cl.[5] ..... G03C 1/34; G03C 7/36

[52] U.S. Cl. ..... 430/551; 430/558; 430/610

[58] Field of Search ..... 430/551, 557, 610

[56] References Cited

U.S. PATENT DOCUMENTS 4,710,453 12/1987 Hirabayashi et al. ..... 430/505
4,749,645 6/1988 Goddard et al. ..... 430/551
4,770,985 9/1988 Takada et al. ..... 430/505
4,791,050 12/1988 Ogawa et al. ..... 430/506

*Primary Examiner*—Charles L. Bowers, Jr.
*Assistant Examiner*—Lee C. Wright
*Attorney, Agent, or Firm*—Sughrue, Mion, Zinn Macpeak & Seas

[57] ABSTRACT

A silver halide color photographic material is described which contains at least one of yellow couplers represented by the following general formula (I) and at least one of compounds represented by the following general formula (A-I):

(I)

wherein $R^1$ represents a substituted or unsubstituted N-phenylcarbamoyl group; $R^2$ represents an alkyl group or an aryl group; $X^1$ represents a group represented by the following formula (a), (b), (c) or (d):

(a)

(b)

wherein $R^3$ and $R^4$, which may be the same or different, each is a hydrogen atom, a halogen atom, a carboxylic acid ester group, an amino group, an alkyl group, an alkylthio group, an alkoxy group, an alkylsulfonyl group, an alkylsulfinyl group, a carboxyl group, a sulfonic acid group or a salt thereof, a substituted or unsubstituted phenyl group or a heterocyclic ring, (c)

wherein $W^1$ represents a non-metallic atom required for forming a four-membered, five-membered or six-membered ring together with the moiety in the formula (c), (d)

wherein $R^0$ represents an N-arylcarbamoyl group, (A-I)

wherein R represents $-(Y)_n-R'$; Y represents —O—, —S—, —NH— or n is 0 or 1; R′ and R″, which may be the same or different, each is a residue of a phosphoric acid; and Q represents a divalent group of the following formula (A-I-1):

(A-I-1)

wherein A represents an atomic group which forms a substituted or unsubstituted benzene ring; X represents a single bond, a substituted or unsubstituted methylene group, —S—, —O—, —NH—, (Abstract continued on next page.)

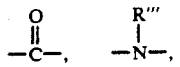
—$SO_2$— or —SO—; R''' represents a hydrogen atom, an alkyl group, an alkenyl group, a cycloalkyl group, an aryl group, a heterocyclic group, an acyl group or a sulfonyl group; and the free bonds in the formula represent the bonding positions to O atoms at the position of Q in the formula (A-I).
19 Claims, No Drawings

SILVER HALIDE PHOTOGRAPHIC MATERIAL CONTAINING A YELLOW COUPLER AND A PHOSPHORUS COMPOUND AND COLOR IMAGE FORMING METHOD

FIELD OF THE INVENTION

This invention relates to a photographic material and more particularly to a silver halide color photographic material having improved reactivity of a yellow coupler with the oxidation product of a color developing agent (hereinafter referred to as color formability) and improved image stability. It also relates to a color image forming method using said photographic material.

BACKGROUND OF THE INVENTION

When silver halide photographic materials are exposed to light and then subjected to color development processing, aromatic primary amine developing agents oxidized by silver halide are reacted with color couplers, whereby color image can be formed.

As yellow couplers, there are known four-equivalent type couplers and α-acylacetanilides where one hydrogen atom of active methylene group is substituted by an aryloxy group, a halogen atom, sulfoxy group, an acyloxy group, etc., described in JP-A-50-87650 (the term "JP-A" as used herein means an "unexamined published Japanese patent application"), U.S. Pat. Nos. 3,369,695, 3,408,194, 3,415,652 and 3,447,928. These couplers have disadvantages in that coupling reaction activity is low and image fastness is poor.

When color formability is insufficient, there are problems that photographic characteristics are greatly varied by changed in the components of developing solutions and images of stable quality can not be obtained. When image fastness is poor, the quality of image is deteriorated during storage. Thus, it is highly demanded to improve image fastness.

As yellow couplers which are more active and freed from the above problems, there are known couplers wherein one hydrogen atom of active methylene group is directly substituted by a nitrogen-containing heterocyclic ring, described in JP-A-47 26133.

However, when these couplers are used, yellow color image is not considered to be fully satisfying with respect to fastness under light and moisture and heat conditions, though formability is improved.

It is highly demanded to reduce the amount of washing water or stabilizing solution from the viewpoint of the preservation of the environment. When the amount is reduced (for example, by a method described in JP-A-57-8543), image fastness is greatly deteriorated. Thus, it is eagerly demanded to find out a method for improving yellow image fastness.

Hindered amines and hindered phenol compounds are described as stabilizers for yellow image in British Patents 1,326,889, 1,354,313 and 1,410,846.

However, effects obtained by these compounds are still unsatisfactory, though the fastness of yellow image is somewhat improved.

SUMMARY OF THE INVENTION

It is, therefore, an object of the present invention to provide a silver halide color photographic material which is excellent in color formability and has improved yellow image fastness.

The inventors have made studies to achieve the above-described object and found that the abovedescribed object can be achieved by providing a silver halide color photographic material containing at least one of yellow couplers represented by the following general formula (I) and at least one of compounds represented by the following general formula (A-I).

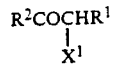

(I)

In the formula (I), $R^1$ represents a substituted or unsubstituted N-phenylcarbamoyl group; $R^2$ represents an alkyl group or an aryl group; Xl represents a group represented by the following formula (a), (b), (c) or (d).

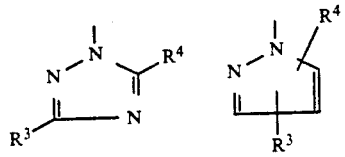

(a) (b)

In the formulae (a) and (b), $R^3$ and $R^4$, which may be the same or different, each is a hydrogen atom, a halogen atom, a carboxylic ester group, an amino group, an alkyl group, an alkylthio group, an alkoxy group, an alkylsulfonyl group, an alkylsulfinyl group, a carboxyl group, a sulfonic acid group or a salt thereof, a substituted or unsubstituted phenyl group or a heterocyclic group.

(c)

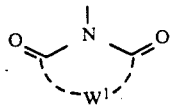

In the formula (c), $W^1$ is a non-metallic atom for forming a four-membered, five-membered or six-memebered ring together with the moiety

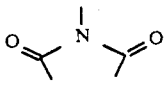

in the group of the formula (c).

(d)

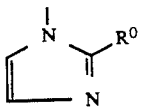

In the formula (d), $R^0$ represents an N arylcarbamoyl group.

(A-I)

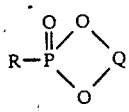

In the formula (A-I), R represents $-(Y)_n-R'$; Y represents —O—, —S—, —NH— or

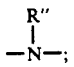

n is 0 or 1; R′ and R″, which may be the same or different, each is a residue of a phosphoric acid; and Q represents a divalent group of the following formula (A-I-1).

(A-I-1)

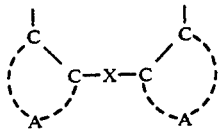

In the formula (A-I-1), A is an atomic group which forms a substituted or unsubstituted benzene ring; X is a single bond, a substituted or unsubstituted methylene group, —S—, —O—, —NH—,

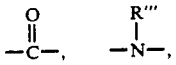

—$SO_2$— or —SO—; and R‴, is a hydrogen atom, an alkyl group, an alkenyl group, a cycloalkyl group, an aryl group, a heterocyclic group, an acyl group or a sulfonyl group.

Free bonds in the formula (A-I-1) represent the bonding positions to O atoms at the position of Q in the formula (A-I).

DETAILED DESCRIPTION OF THE INVENTION

The two-equivalent type couplers for use in the present invention are the compounds represented by the formula (I) and are illustrated in more detail below.

In the formula (I), $R^1$ is a substituted or unsubstituted N-phenylcarbamoyl group, substituent groups for said N-phenylcarbamoyl group may be conventional groups for yellow couplers. Examples of the substituent groups include an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, a carboxyl group, a sulfo group, a nitro group, a cyano group and a thiocyano group. The substituted N-phenylcarbamoyl group may have two or more substituent groups. These two or more substituent groups may be the same or different.

When $R^2$ is an alkyl group, a tertiary alkyl group having from 4 to 20 carbon atoms is preferred. Examples of the alkyl group include t-butyl, t-amyl, t-ocyl, 1,1-diethylpropyl, 1,1-dimethylhexyl and 1,1,5,5-tetramethylhexyl. Typical examples of substituent groups for the substituted alkyl group and the substituted aryl group are those already described above in the definition of $R^1$.

The coupling off group represented by $X^1$ is a group which is released by coupling to form a two-equivalent type coupler. Namely, the group $X^1$ is a group represented by the following formula (a), (b), (c) or (d).

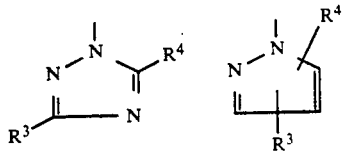

(a) (b)

In the formulae (a) and (b), $R^3$ and $R^4$, which may be the same or different, each is a hydrogen atom, a halogen atom, a carboxylic ester group, an amino group, an alkyl group, an alkylthio group, an alkoxy group, an alkylsulfonyl group, an alkylsulfinyl group, a carboxyl group, a sulfonic acid group or a salt thereof (e.g., an alkali metal salt or ammonium salt thereof), an unsubstituted or substituted phenyl group or a heterocyclic group.

(c)

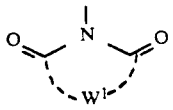

In the formula (c), W′ is a non-metallic atom required for forming a four-membered, five-membered or six-memebered ring together with the moiety

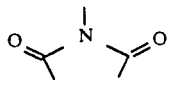

in the formula (c).

(d)

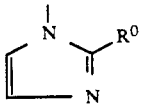

In the formula (d), $R^0$ represents an N-aryl carbamoyl group.

Preferred examples of compounds which can be used as the yellow couplers in the present invention include compounds represented by the following general formula. (I′).

(I′)

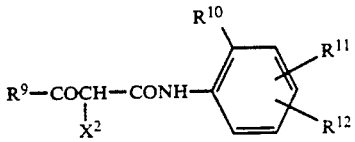

In the formula (I′), $R^9$ is a tertiary alkyl group having from 4 to 12 carbon atoms, or a phenyl group which may be substituted by a halogen atom, an alkyl group or an alkoxy group; $R^{10}$ is a halogen atom or an alkoxy group; $R^{11}$ is a hydrogen atom, a halogen atom or an alkoxy group which may be optionally substituted; $R^{12}$ is an acylamino group which may be optionally substituted, an alkoxycarbonyl group, an alkylsulfamoyl group, an acylsulfamoyl group, an arylsulfamoyl group, an alkylsulfonamido group, an arylsulfonamide group, an alkylureido group, an arylureido group, a succinimido group, an alkoxy group or an aryloxy group; and $X^2$ is a group represented by the following general formula (e), (f), (g) or (h).

(e)

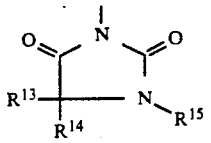

(f)

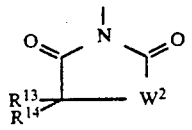

(g)

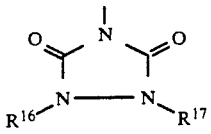

(h)

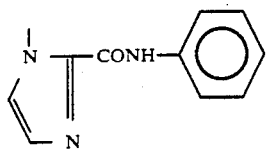

In the formulae (e), (f) and (g), $R^{13}$ and $R^{14}$ each is a hydrogen atom, an alkyl group, an aryl group, an alkoxy group, an aryloxy group or a hydroxyl group; $R^{15}$, $R^{16}$ and $R^{17}$ each is a hydrogen atom, an alkyl group, an aryl group, an aralkyl group or an acyl group; and $W^2$ is an oxygen atom or a sulfur atom.

Particularly preferred examples of the yellow couplers which can be used in the present invention are compounds represented by the following general formula (I'').

(I'')

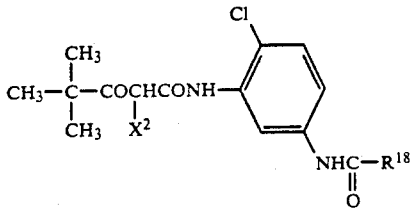

In the formula (I''), $R^{18}$ is a substituted or unsubstituted alkyl group or phenyl group; and $X^2$ is the group represented by the formula (e), (f) or (g) as set forth in the formula (I').

These yellow couplers can be synthesized according to methods described in JP-B-51-10783 (the term "JP-B" as used herein means an "examined Japanese patent publication"), JP-B-51-33410, JP-B-51 33410, JP-A-47-26133, JP-A-48-73147, JP-A-51-102636, JP-A-52-82424, JP-A-52-115219, British Patent 1,425,020 and West German Patent 1,547,868.

Concrete examples of the yellow couplers represented by the formula (I) include, but are not limited to, the following compounds.

(Y-1)

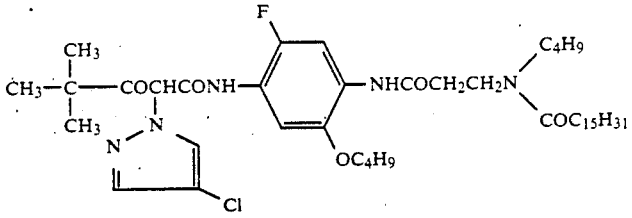

(Y-2)

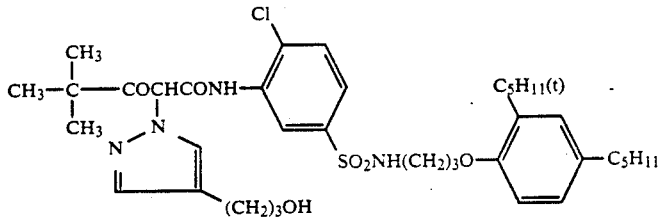

(Y-3)

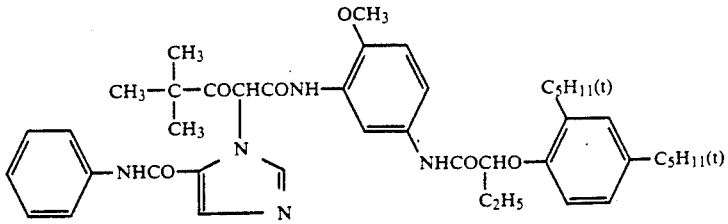

-continued
(Y-4)
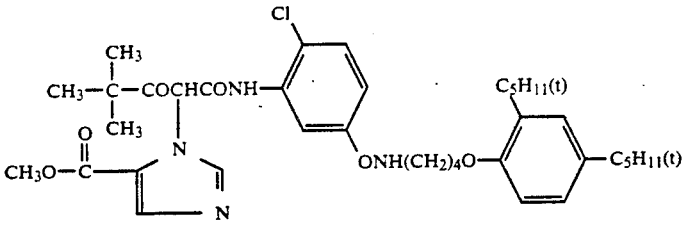
(Y-5)
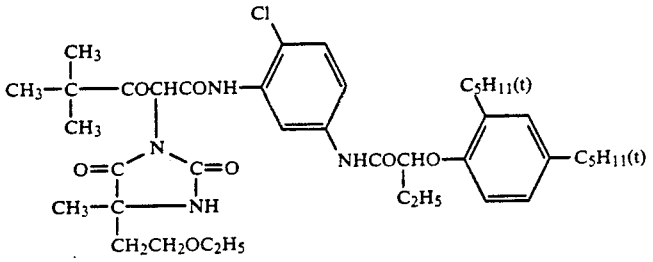
(Y-6)
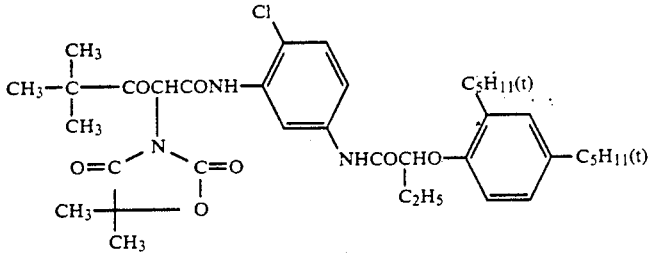
(Y-7)
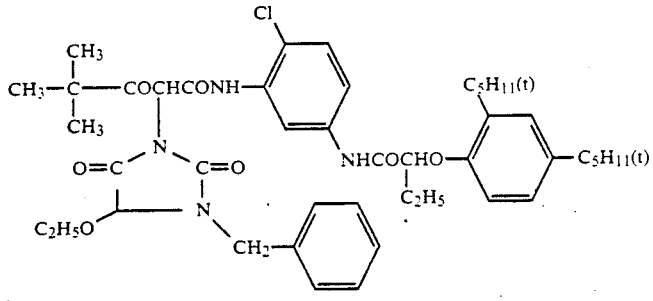
(Y-8)
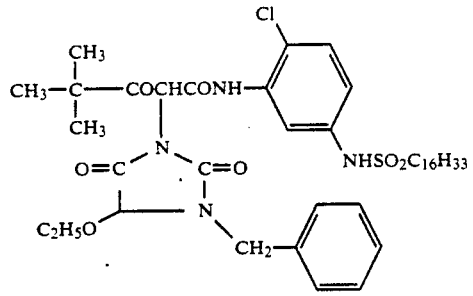
(Y-9)
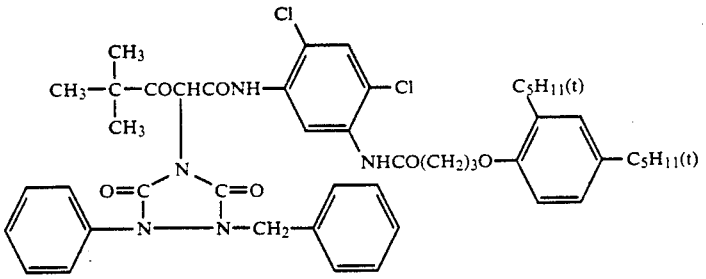

-continued
(Y-10)
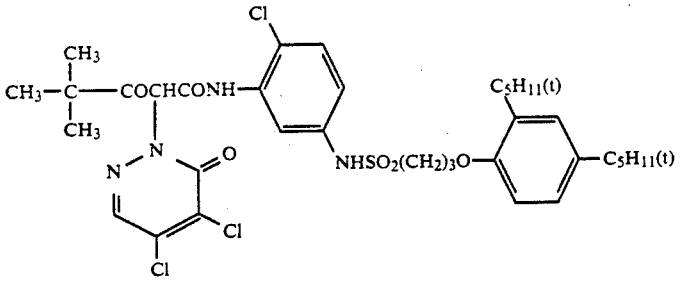
(Y-11)
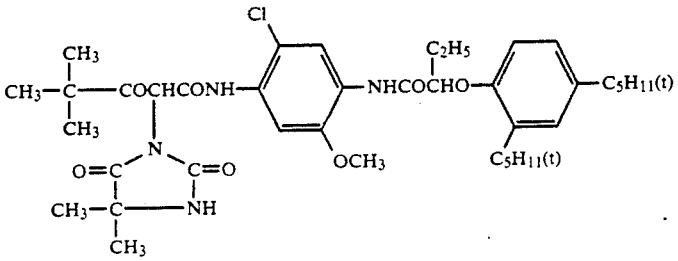
(Y-12)
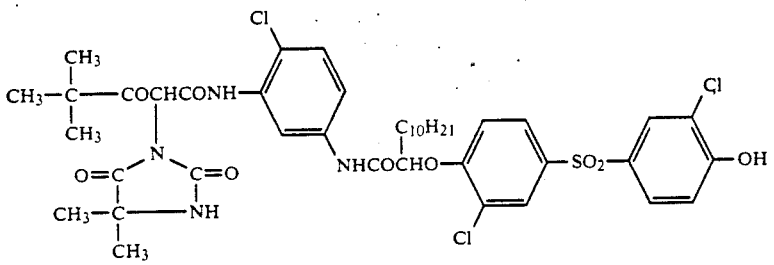
(Y-13)
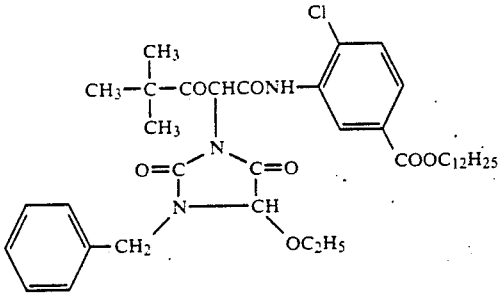
(Y-14)
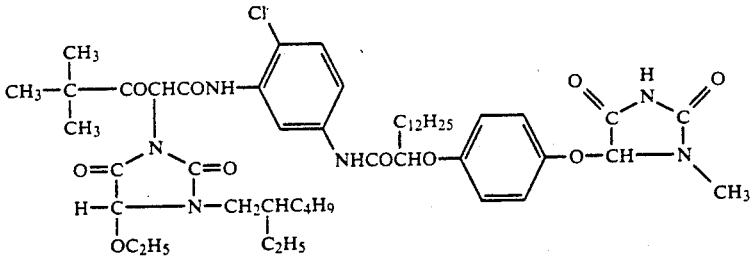
(Y-15)
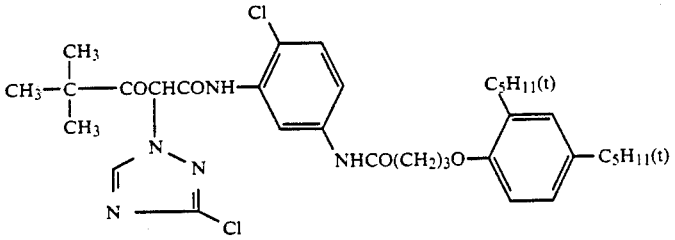

-continued
(Y-16)
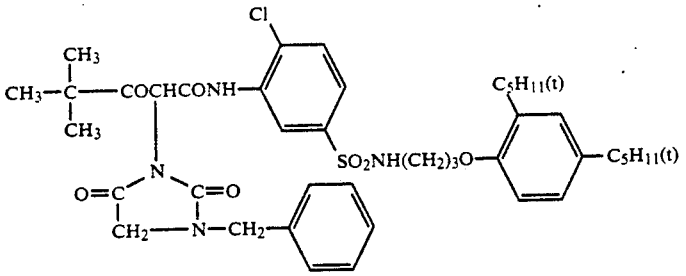
(Y-17)
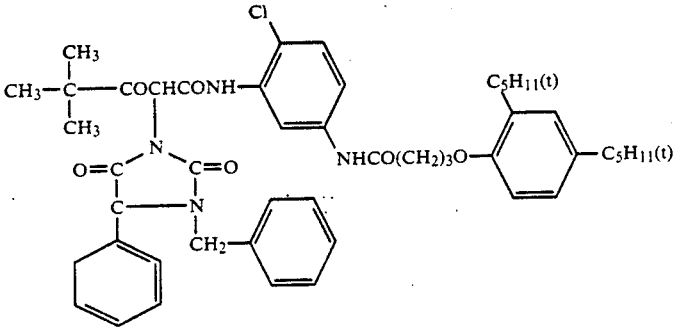
(Y-18)
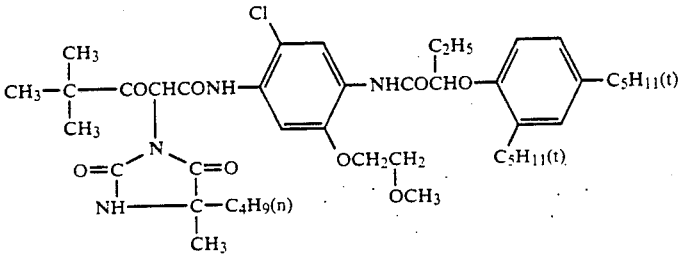
(Y-19)
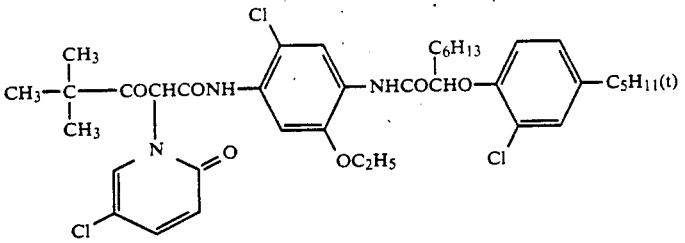
(Y-20)
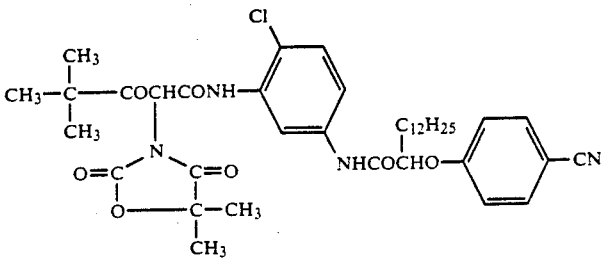

-continued
(Y-21)
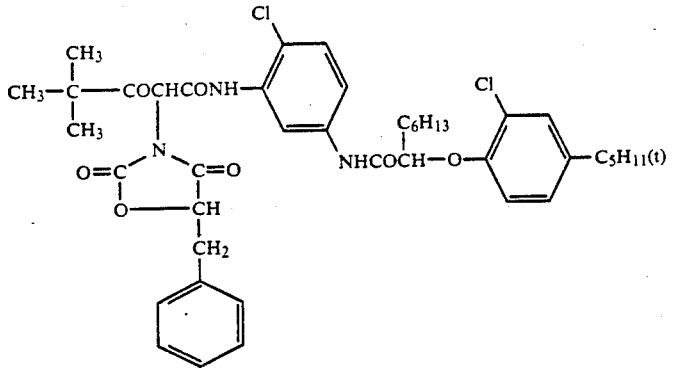
(Y-22)
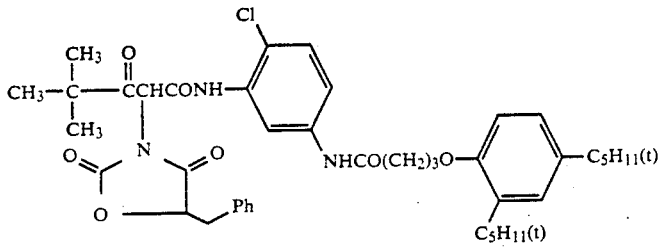
(Y-23)
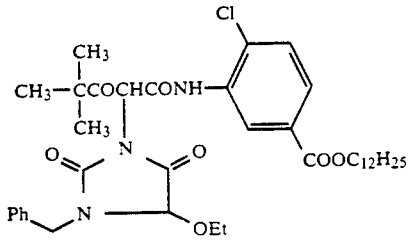
(Y-24)
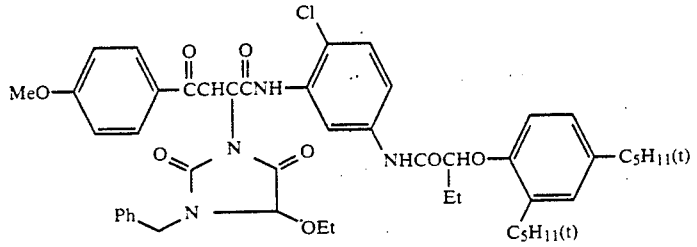
(Y-25)
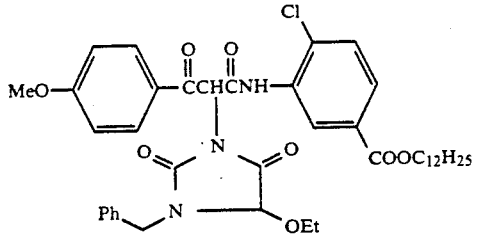
(Y-26)
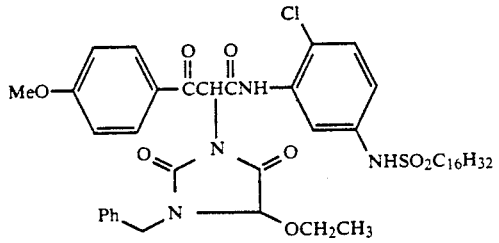

-continued (Y-27)

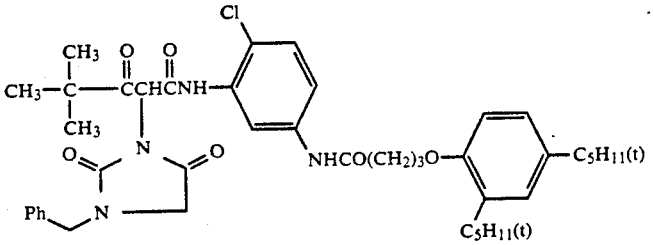

(Y-28)

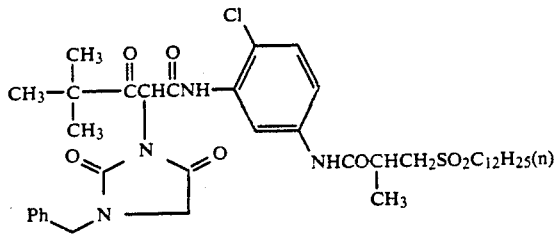

Ph = phenyl group
Me = methyl group
Et = ethyl group
⌣ = methylene group (—$CH_2$—)

(Y-29)

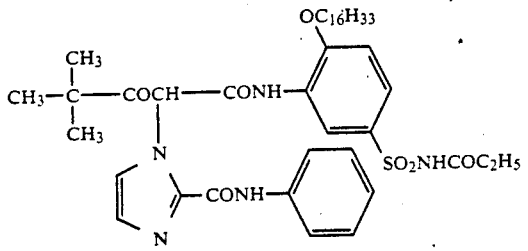

The groups of the compounds represented by the formula (A-I) will be illustrated in more detail below.

The residue of a phosphoric acid represented by R' and R'' means a residue of a phosphoric ester which constitutes the compounds of the formula (A-I). Examples of the residue include an alkyl group, an alkenyl group, a cycloalkyl group, an aryl group, a heterocyclic group and an acyl group.

Among the compounds of the formula (A-I), compounds where n is 0 or 1 and Y is —O— are preferred from the viewpoint of the effect of the present invention.

The groups represented by the formula (A-I-I) will be illustrated in more detail below.

Among the groups represented by the formula (A-I1), groups represented by the following general formula (A-I-2) are preferred.

(A-I-2)

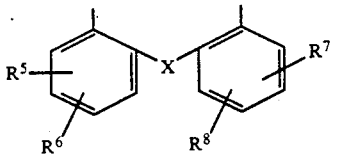

In the formula (A-I-2), free bonds and X are the same as those set forth in the formula (A-I-1); and $R^5$, $R^6$, $R^7$ and $R^8$ each is a hydrogen atom or a substituent group.

The groups $R^5$, $R^6$, $R^7$, $R^8$ and X in the formula (A-I 2) will be illustrated in more detail below.

In the formula (A-I-2), $R^5$, $R^6$, $R^7$ and $R^8$ each is a hydrogen atom or a substituent group. Preferred examples of the substituent group include an aliphatic group, an aromatic group (e.g., phenyl, naphthyl), a heterocyclic ring (e.g., 2-pyridyl, 2-tetrahydropyranyl), a halogen atom (e.g., fluorine, chlorine, bromine), an aliphatic oxy group (e.g, methoxy, butoxy), an acyloxy group (e.g., acetoxy, benzoyloxy), a sulfonyloxy group (e.g., benzenesulfonyloxy), an acylamino group (e.g., acetylamino, benzoylamino), a sulfonamido group (e.g., methanesulfonamido), an amino group, an aliphatic or aromatic oxycarbonyl group (e.g., phenoxycarbonyl, butoxycarbonyl), a carbamoyl group (e.g., dimethylcarbamoyl, phenylcarbamoyl) and a hydroxy group.

X is preferably a substituted or unsubstituted methylene group (e.g., methylene, isopropylidene), an acyl bond, an oxygen atom, a sulfur atom, a sulfonyl bond or an amino group.

The term "aliphatic group" as used herein means a straight-chain, branched or cyclic aliphatic hydro carbon group including a saturated or unsaturated group such as an alkyl group, an alkenyl group and an alkynyl group. Typical examples of the aliphatic group include methyl, ethyl, butyl, dodecyl, octadecyl, eicosenyl, isopropyl, tert-butyl, tert-octyl, tert-dodecyl, cyclo hexyl, cyclopentyl, allyl, vinyl, 2-hexadecenyl and propargyl groups.

Among the above-described substituent groups, groups which can be further substituted may be optionally substituted by further substituent groups such as an alkyl group, an aryl group, a heterocyclic group, an alkoxy group (e.g., methoxy, 2-methoxyethoxy), an aryloxy group (e.g., 2,4-di tert-amylphenoxy, 2-chlorophenoxy, 4-cyanophenoxy), an alkenyloxy (e.g., 2propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy), an amido group (e.g., acetylamino, ethylcarbamoyl, dimethylcarbamoyl, methanesulfonamido, butylsulfamoyl), a sulfamido group (e.g., dipropylsulfamoylamino), an imido group (e.g., succinimido, hydantoinyl), an ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxyl group, a cyano group, a carboxyl group, a nitro group, a sulfo group and a halogen atom.

Concrete examples of the compounds represented by the formula (A-I) include, but are not limited to, the following compounds.

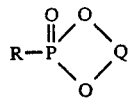

| Compound | Q | R |
|---|---|---|
| A-1 | 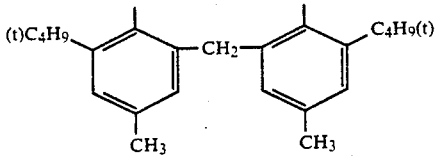 | $-OC_4H_9$ |
| A-2 | " | $-OCH_2\underset{}{\overset{C_2H_5}{\overset{\vert}{C}}}HC_4H_9$ |
| A-3 | " | $-OC_8H_{17}$ |
| A-4 | " | $-OC_{12}H_{25}$ |
| A-5 | " | $-OC_{16}H_{33}$ |
| A-6 | " | $-OC_{18}H_{37}$ |
| A-7 | " | 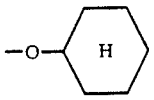 |
| A-8 | " | 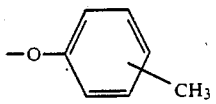 |
| A-9 | " | 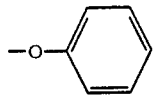 |
| A-10 | " | 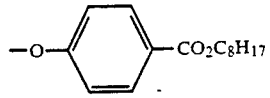 |
| A-11 | 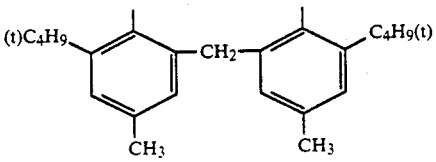 | 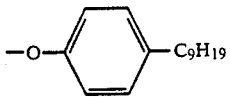 |
| A-12 | " | 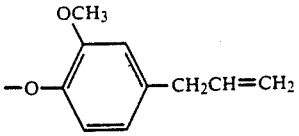 |

-continued
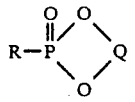
| Compound | Q | R |
|---|---|---|
| A-13 | " | 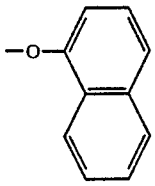 |
| A-14 | " | $-OCH_2CH_2OC_4H_9$ |
| A-15 | " | $-SC_8H_{17}$ |
| A-16 | " | 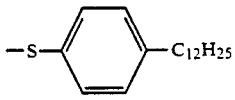 |
| A-17 | " | $-NHC_4H_9$ |
| A-18 | " | 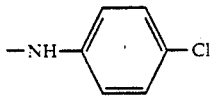 |
| A-19 | " | 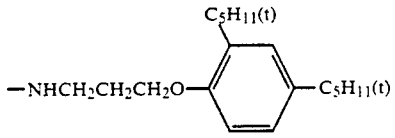 |
| A-20 | " | 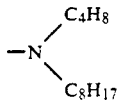 |
| A-21 | 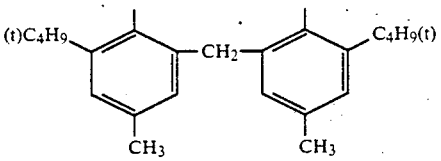 | 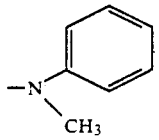 |
| A-22 | " | $-C_8H_{17}$ |
| A-23 | " | 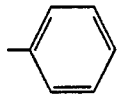 |
| A-24 | 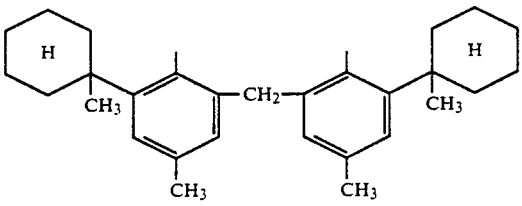 | $-OCH_3$ |
| A-25 | " | $-OCH_2CH(C_2H_5)C_4H_9$ |
| A-26 | " | $-OCH_2CH(CH_3)CH_2CH_2CH_3$ |

-continued
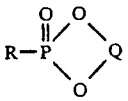
| Compound | Q | R |
|---|---|---|
| A-27 | " | $-OC_9H_{19}(i)$ |
| A-28 | " | $-OC_{13}H_{27}(i)$ |
| A-29 | 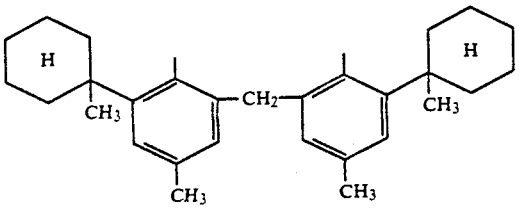 | 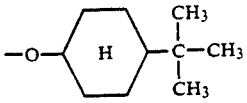 |
| A-30 | " | $-OCH_2CH_2Cl$ |
| A-31 | " | 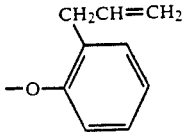 |
| A-32 | " | 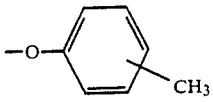 |
| A-33 | " | 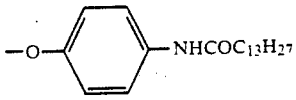 |
| A-34 | " | $-S-C_6H_{13}$ |
| A-35 | " | 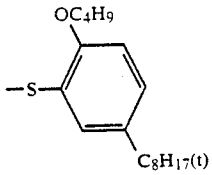 |
| A-36 | " | $-NHC_8H_{17}$ |
| A-37 | " | 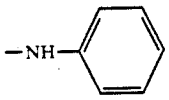 |
| A-38 | " | 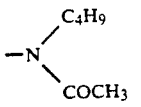 |
| A-39 | 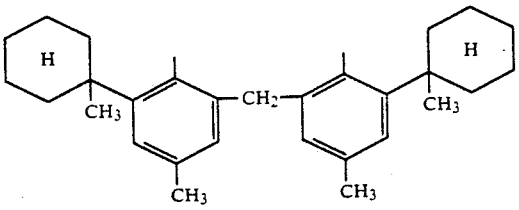 | $-C_{10}H_{21}$ |

-continued
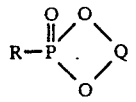
| Compound | Q | R |
|---|---|---|
| A-40 | 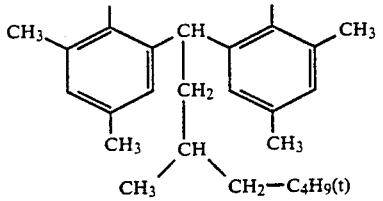 | $-OC_6H_{13}$ |
| A-41 | " | $-OCH_2\overset{C_2H_5}{\overset{\vert}{C}}HC_4H_9$ |
| A-42 | " | $-OC_{18}H_{37}(i)$ |
| A-43 | " | $-O\text{-}(CH_2)_8CH{=}CH_2$ |
| A-44 | " | 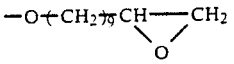 |
| A-45 | 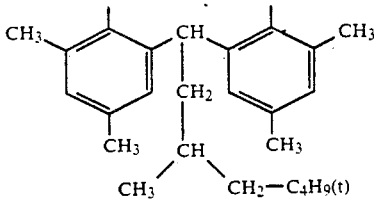 | 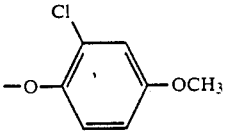 |
| A-46 | " | 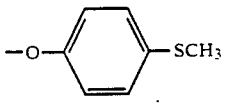 |
| A-47 | " | $-SC_{16}H_{33}$ |
| A-48 | " | 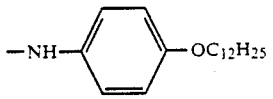 |
| A-49 | " | 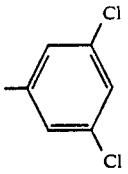 |
| A-50 | " | $-C_6H_{13}$ |
| A-51 | 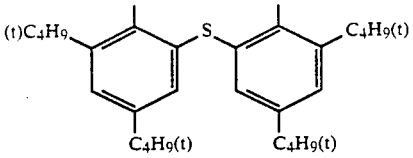 | $-OC_3H_7$ |
| A-52 | 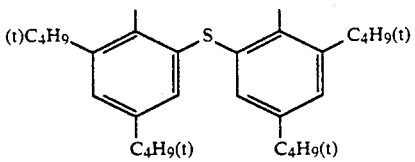 | $-OC_8H_{17}$ |

-continued
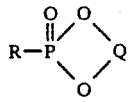
| Compound | Q | R |
|---|---|---|
| A-53 | " | $-OC_{13}H_{27}(i)$ |
| A-54 | " | 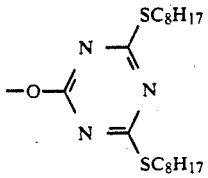 |
| A-55 | " | 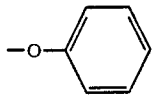 |
| A-56 | " | 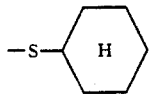 |
| A-57 | " | 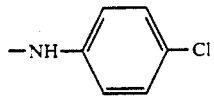 |
| A-58 | " | 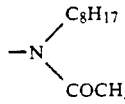 |
| A-59 | " | 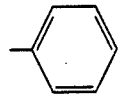 |
| A-60 | 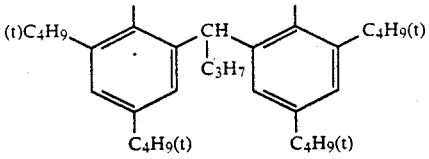 | 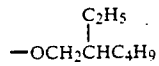 |
| A-61 | " | 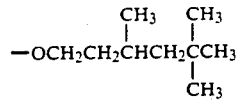 |
| A-62 | " | $-OC_{16}H_{33}$ |
| A-63 | " | 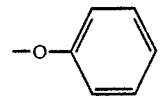 |
| A-64 | " | 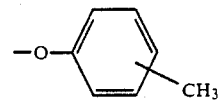 |

-continued
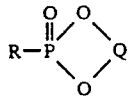
| Compound | Q | R |
|---|---|---|
| A-65 | " | 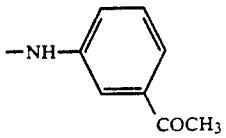 |
| A-66 | 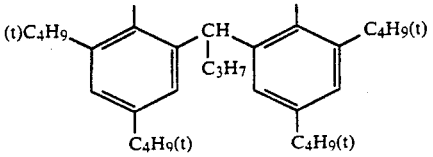 | $-C_8H_{17}$ |
| A-67 | 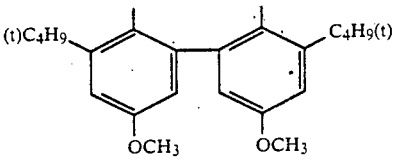 | $-OCH_2\overset{C_2H_5}{\overset{\vert}{C}}HC_4H_9$ |
| A-68 | 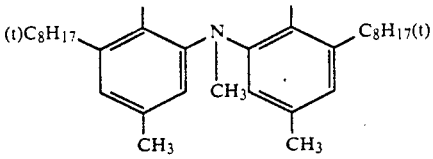 | " |
| A-69 | 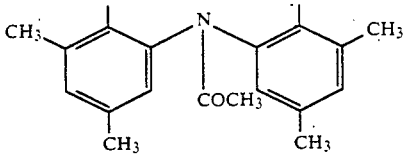 | " |
| A-70 | 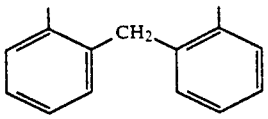 | " |
| A-71 | 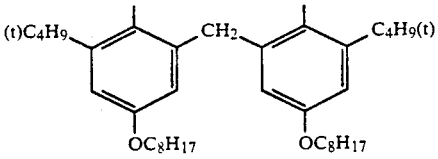 | $-OCH_2\overset{C_2H_5}{\overset{\vert}{C}}HC_4H_9$ |
| A-72 | 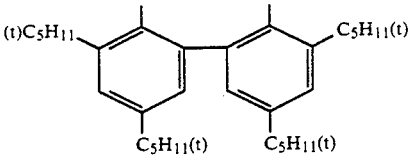 | 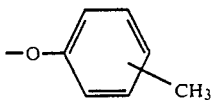 |

-continued
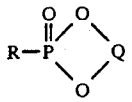
| Compound | Q | R |
|---|---|---|
| A-73 | 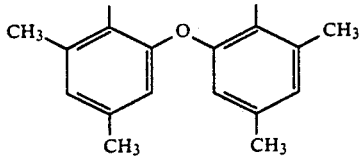 | " |
| A-74 | 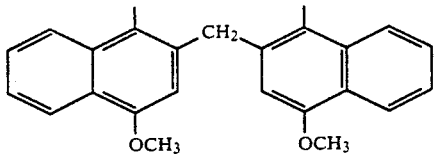 | " |
| A-75 | 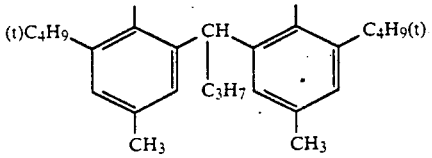 | $-OC_4H_9$ |
| A-76 | " | 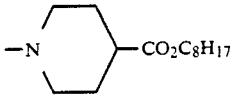 |
| A-77 | " | 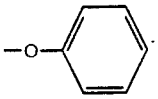 |
| A-78 | 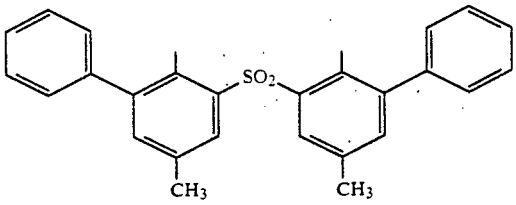 | $-OCH_3$ |
| A-79 | 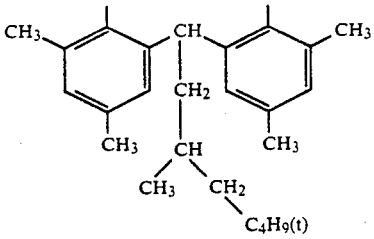 | 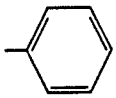 |
| A-80 | 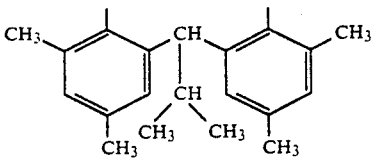 | 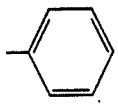 |

-continued

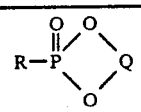

| Compound | Q | R |
|---|---|---|
| A-81 | 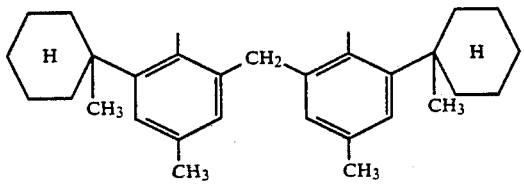 | " |

The compounds represented by the formula (A-I) can be easily synthesized as follows. That is, first bisphenols are synthesized according to methods described in U.S. Pat. Nos. 2,735,765 and 3,700,455 and JP-A-62-262047 and then the resulting bisphenols react with phosphorus oxychloride, or phosphoric acid or phosphorous acid dichloride according to methods described in the literature "Organophosphorus Compounds", John Wiley & Sons, Inc., New York, 1950, p. 226, p. 228, U.S. Pat. Nos. 3,209,021 and 4,278,757.

Preferably, $1\times10^{-3}$ to 1 mol, more preferably $5\times10^{-2}$ to $5\times10^{-1}$ mol (per mol of silver halide existing in the same layer) of the coupler of the formula (I) is added to emulsion layer.

Preferably 1 to 200 mol %, more preferably 2 to 30 mol % (based on the coupler of the formula (I)) of the compound of the formula (A-I) is added.

In the practice of the present invention, it is preferred that the lipophilic coupler of the formula (I) and the compound of the formula (A-I) are dissolved in or impregnated with lipophilic fine particles. Materials constituting the lipophilic fine particles are oily solvents (including solid at room temperature such as wax) for additives such as the coupler in addition to said compound, or materials serving as additives as well as oily solvents such as polymer, coupler, antistain agent, ultraviolet light absorber, etc.

The term "lipophilic fine particles" mean fine particles which are substantially insoluble in aqueous gelatin solution and exist as a separate phase in the aqueous gelatin solution.

The lipophilic fine particles of the present invention can be generally prepared by dissolving the coupler having the formula (I) and the compound having the formula (A-I) in a high-boiling solvent (oil) having a boiling point of not lower than 170° C. under atmospheric pressure, or a low-boiling solvent (when oil is not required) or a mixed solvent of said oil and said low-boiling solvent and then emulsifying the resulting solution in an aqueous solution of hydrophilic colloid such as gelatin. Thought there is no particular limitation with regard to the particle diameter (grain size) of the lipophilic fine particle, a particle diameter of 0.05 to 0.5 μm, particularly 0.1 to 0.3 μm is preferred.

The ratio of said oil/said coupler is in the range of preferably 0.01 to 4.0 by weight.

It is preferred that lipophilic fine particles are formed by the compound having the formula (A-I) together with at least one of phenolic cyan couplers or diphenylimidazole cyan couplers and at least one of water-insoluble but organic solvent-soluble homopolymers or copolymers and an emulsion of said fine particles is mixed with silver halide emulsion and used. Namely, a color photograph obtained by using a color photographic material containing such a silver halide emulsion is excellent in color image preservability even under high temperature and humidity conditions and can exhibit good color image-preservability even in the case where replenishment rate per unit area of the silver halide color photographic material to be processed in the water washing stage or stabilizing stage is as very low as 0.5 to 50 times the amount of carried over (brought over) from the previous bath in a processing method comprising carrying out the water washing stage or stabilizing stage after desilverization subsequent to the color development processing.

A similar effect can be achieved by the following silver halide color photographic material. Namely, said material is a silver halide color photographic material comprising red-sensitive, green-sensitive and blue-sensitive silver halide emulsion layers provided on a support, wherein at least one of said compounds having the formula (A-I) is contained in at least one layer containing a color coupler, at least one of compounds having the formula (III) is contained in at least one layer of light-insensitive gelatin-containing layers and at least one of compounds having the following formula (U-II) is contained in at least one layer containing a color coupler.

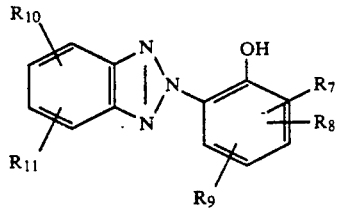

(III)

In the formula (III), $R^7$, $R^8$, $R^9$, $R^{10}$ and $R^{11}$, which may be the same or different, each is a hydrogen atom, a halogen atom, a nitro group, a hydroxyl group, an alkyl group, an alkenyl group, an aryl group, an alkoxy group, an acyloxy group, an aryloxy group, an alkylthio group, an arylthio group, a mono- or dialkylamino group, an acylamino group or a five-membered or six-membered oxygen or nitrogen-containing heterocyclic group. $R^{10}$ and $R^{11}$ may be combined together to form a five-membered or six-membered aromatic ring composed of carbon atoms.

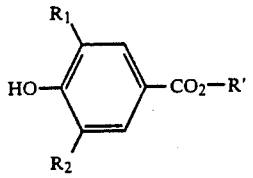

(U-II)

In the formula (U-II), $R^1$ and $R^2$, which may be the same or different, each is an alkyl group; R' is a substituted or unsubstituted alkyl group or aryl group.

The color photographic material of the present invention comprises at least one blue-sensitive silver halide emulsion layer, at least one green sensitive silver halide emulsion layer and at least one red-sensitive silver halide emulsion layer provided on a support. In conventional color photographic paper, said layers are coated in the above-described order on the support. If desired, said layers may be coated in different order. An infrared-sensitive silver halide emulsion layer can be used in place of at least one of the above-described emulsion layers. Color reproduction by subtractive color photography can be made by incorporating silver halide emulsions having sensitivity to each wave range and couplers in these sensitive emulsion layers, said couplers forming dyes having a complementary color relationship to light for exposure (namely, yellow image to blue light, magenta image to green light and cyan image to red light). If desired the photographic material is so constituted that the sensitive layers do not have the above-described relationship with the developed hues of the couplers.

As the silver halide for the silver halide emulsion of the present invention, silver iodobromide and silver chloroiodobromide are preferred and the preferred content of silver iodide is 1 to 15 mol %, when the silver halide emulsion is used for color photographic material for photographing, while a silver halide emulsion comprising silver chloride or silver chlorobromide containing substantially no silver iodide (substantially free from silver iodide) is preferred, when the emulsion is used for color printing photo graphic material.

The term "containing substantially no silver iodide" or "substantially free from silver halide" as used herein means that the content of silver iodide is not higher than 1 mol%, preferably not higher than 0.2 mol %. The halogen composition of the emulsion may be different among grains or the grains are equal in the halogen composition. However, when emulsions comprising grains equal in the halogen composition are used, the property of each grain can be easily homogenized. With regard to the distribution of halogen composition in the interior of silver halide emulsion grains, there can be used any of uniform structure type grain wherein any area of silver halide grains is equal in its composition; integral structure type grain wherein core in the interior of the silver halide grain is different in halogen composition from shell (a single layer or multi-layer) surrounding the core; and grain having such a structure that a non-laminar area having a different halogen composition is formed in the interior of the grain or on the surface of the grain (when formed on the surface of the grain, the area having a different composition is joined to the edge, corner or surface of the grain). For the purpose of providing high sensitivity, the above-described second and third grain structures are preferable to the uniform structure type grain and they are preferred from the viewpoint of pressure resistance. When the silver halide grains have the above-described structures, the boundary between the areas having different halogen compositions may be clear or indistinct by the formation of a mixed crystal due to a difference in the composition, or structural change may be continuous.

With regard to the halogen composition of the silver chlorobromide emulsion, the ratio of silver bromide/silver chloride can be widely varied according to the purpose of use, but the content of silver chloride of not lower than 2 mol% is preferred.

High-silver chloride emulsions having a high silver chloride content are preferred for photographic materials suitable for use in rapid processing. The silver chloride contents of these high-silver chloride emulsions are preferably not lower than 90 mol %, more preferably not lower than 95 mol %.

It is preferred that the high-silver chloride emulsion has such a layered or non-layered structure that a silver bromide-localized phase exists in the interior and/or on the surface of the silver halide grain. The halogen composition of said localized phase is such that the content of silver bromide is preferably at least 10 mol %, more preferably higher than 20 mol %. These localized phases may exist in the interiors of the grains or on the edge, corners or surfaces of the grains. In a preferred embodiment, the localized phases are formed on the corners of the grains by epitaxial growth.

It is preferred to use the uniform structure type grains having a narrow halogen composition distribution even in the high-silver chloride emulsions having a silver chloride content of at least 90 mol % to prevent sensitivity from being lowered when pressure is applied to photographic materials.

The replenishment rates of processing solutions can be reduced by further increasing the silver chloride content of the silver halide emulsion. In such a case, an almost pure silver chloride emulsion having a silver chloride content of as high as 98 to 99.9 mol % can be preferably used.

The average grain size (the diameter of a circle equivalent to the projected area of the grain is allowed to be a grain size and the average is referred to as average grain size) of the silver halide grains contained in the silver halide emulsion of the present invention is in the range of preferably 0.1 to 2 μm.

The coefficient of variation (a value obtained by dividing the standard deviation of the grain size by the average grain size) of the grain size distribution is preferably not higher than 20%, particularly not higher than 15%. Monodisperse type, with a coefficient of variation being within said range, is preferred. It is also preferred that such monodisperse emulsions are contained in the same layer or are coated in the form of a multi-layer for the purpose of obtaining a wide latitude.

The shape of the silver halide grain to be contained in the photographic emulsion of the present invention may be a regular crystal form such as cube, octahedron or tetradecahedron or an irregular crystal form such as a spherical form or a tabular form or a composite form thereof. If desired, a mixture of grains having these crystal forms may be used. In the present invention, silver halide grains comprising at least 50%, preferably at least 70%, more preferably at least 90% of the grains having the regular crystal form are preferred.

In addition thereto, there can be preferably used emulsions wherein tabular grains having an average aspect ratio (ratio of diameter in terms of a circle/thickness) of not lower than 5, preferably not lower than 8 account for at least 50% (in terms of projected area) of the total amount of grains.

The silver chlorobromide emulsion of the present invention can be prepared by methods described in "Chimie et Phisique Photographique", written by P. Glafkides (published by Paul Montel, 1967), "Photographic Emulsion Chemistry", written by G. F. Duffin (published by Focal Press, 1966) and "Making and Coating Photographic Emulsion", written by V. L. Zelikman et al (published by Focal Press, 1964). Namely, the emulsion of the present invention can be prepared by any of acid process, neutral process and ammonia process. In the preparation thereof, a soluble silver salt can be reacted with a soluble halogen salt by any method of a single jet method, a double jet method and a combination thereof. A reverse mixing method wherein grains are formed in the presence of an excess amount of silver ion, can also be used. As a mode of the double jet method, a controlled double jet method wherein a pAg value in a liquid phase is kept constant, can be used. According to this method, there can be obtained a silver halide emulsion wherein the crystal form of the grain is regular and the grain size is almost uniform.

Various polyvalent metal ion impurities can be introduced into the silver halide emulsion of the present invention during the course of the formation of emulsion grains or during the course of the physical ripening thereof. Examples of compounds used therefor include salts of cadmium, zinc, lead, copper and thallium and salts and complex salts of Group VIII elements such as iron, ruthenium, rhodium, palladium, osmium, iridium and platinum. Among them, Group VIII elements are preferred. The amounts of these compounds to be added widely vary depending on the purpose of use, but are generally in the range of preferably $10^{-9}$ to $10^{-2}$ mol based on the amount of silver halide.

The silver halide emulsions of the present invention are generally subjected to chemical sensitization or spectral sensitization.

Examples of the chemical sensitization include sulfur sensitization (sensitization being conducted typically by adding unstable sulfur compounds), noble metal sensitization such as gold sensitization and reduction sensitization. These sensitization methods may be used either alone or in a combination thereof. Preferred compounds which can be used for the chemical sensitization are described in JP-A-62-215272 (from the lower right column of page 18 of the specification to the upper right column of page 22 thereof).

The spectral sensitization is carried out to impart spectral sensitivity to the desired light wave range of each emulsion. It is preferred that dyes absorbing light in wave range corresponding to the desired spectral sensitivity, that is, spectral sensitizing dyes are added. Examples of the spectral sensitizing dyes include those described in the literature "Heterocyclic Compounds—Cyanine Dyes and Related Compounds", written by F. M. Harmer, published by John Wiley & Sons (New York, London) 1964. Preferred compounds are described in JP-A-62-215272 (from the upper right column of page 22 of the specification to page 38 thereof).

Various compounds or precursors thereof can be added to the silver halide emulsions for use in the present invention for the purpose of preventing fogging from being caused during the course of the preparation of photographic materials or the storage thereof or during the course of photographic processing or for the purpose of stabilizing photographic performance. These compounds and precursors are generally called photographic stabilizers. Preferred examples of these compounds include those described in JP-A-62-215272 (from page 39 of the specification to page 72 thereof).

The emulsions for use in the present invention may be any of a surface latent image type wherein a latent image is predominantly formed on the surface of the grain and an internal latent image type wherein a latent image is predominantly formed in the interior of the grain.

The color photographic material of the present invention generally contain a yellow coupler, a magenta coupler and a cyan coupler, said couplers forming yellow color, magenta color and cyan color, respectively, by the reaction of each of them with the oxidation product of an aromatic amine developing agent.

Preferred examples of the cyan coupler and the magenta coupler which can be used in the present invention include compounds represented by the following formulae (C-I), (C-II), (M-I) and (M-II).

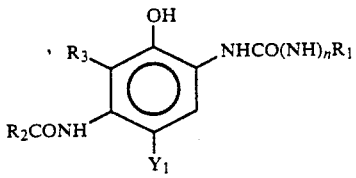

(C-I)

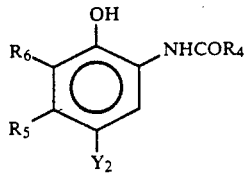

(C-II)

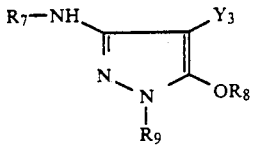

(M-I)

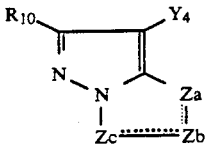

(M-II)

In the formulae (C-I) and (C-II), $R_1$, $R_2$ and $R_4$ each represents a substituted or unsubstituted aliphatic, aromatic or heterocyclic group; $R_3$, $R_5$ and $R_6$ each represents a hydrogen atom, a halogen atom, an aliphatic group, an aromatic group or an acylamino group or $R_3$ may be a non-metallic atomic group which is combined together with R2 to form a 5-membered or 6-membered nitrogen-containing ring; and $Y_1$ and $Y_2$ each represents a hydrogen atom or a group which can be released by the reaction with the oxidation product of a developing agent.

Preferred examples of $R_5$ in the formula (C-II) are aliphatic groups such as methyl, ethyl, propyl, butyl, pentadecyl, tert-butyl, cyclohexyl, cyclohexylmethyl, phenylthiomethyl, dodecyloxyphenylthiomethyl, butaneamidomethyl and methoxymethyl.

Preferred cyan couplers represented by the formulae (C-I) and (C-II) are the following compounds.

There are preferred the compounds of the formula (C-I) where $R_1$ is an aryl group or a heterocyclic ring. There are more preferred the compounds where said aryl group is substituted by one or more of a hydrogen atom, an alkyl group, an alkoxy group, an aryloxy group, an acylamino group, an acyl group, a carbamoyl group, a sulfonamido group, a sulfamoyl group, a sulfonyl group, a sulfamido group, a hydroxycarbonyl group and a cyano group.

In the case where $R_3$ and $R_2$ are not combined together to form a ring, there are preferred the compounds of the formula (C-I) where $R_2$ is a substituted or unsubstituted alkyl group or an aryl group, particularly a substituted aryloxy-substituted alkyl group and $R_3$ is a hydrogen atom.

There are preferred the compounds of the formula (C-II) where $R_4$ is a substituted or unsubstituted alkyl group or an aryl group, particularly a substituted aryloxy-substituted alkyl group.

There are preferred the compounds of the formula (C-II) where $R_5$ is an alkyl group having from 2 to 15 carbon atoms or a methyl group having $C_1$ or higher substituent group. Preferred substituent groups are an arylthio group, an alkylthio group, an acylamino group, an aryloxy group and an alkyloxy group. There are more preferred the compounds of the formula (C-II) where $R_5$ is an alkyl group having from 2 to 15 carbon atoms, particularly an alkyl group having from 2 to 4 carbon atoms.

There are preferred the compounds of the formula (C-II) where $R_6$ is a hydrogen atom or a halogen atom, particularly chlorine or fluorine. Preferred examples of $Y_1$ and $Y_2$ in the formulae (C-I) and (C-II) are a hydrogen atom, a halogen atom, an alkoxy group, an aryloxy group, an acyloxy group and a sulfonamido group.

In the formula (M-I), $R_7$ and $R_9$ each represents an aryl group; $R_8$ represents a hydrogen atom, an aliphatic or aromatic acyl group or an aliphatic or aromatic sulfonyl group; and $Y_3$ represents a hydrogen atom or a coupling off group. The aryl group (preferably phenyl group) represented by $R_7$ and $R_9$ may have one or more substituent groups. Examples of the substituent groups are those already described above in the definition of the substituent groups for $R_1$. When two or more substituent groups exist, they may be the same or different groups. $R_8$ is preferably a hydrogen atom or an aliphatic acyl or a sulfonyl group. A hydrogen atom is particularly preferred. $Y_3$ is preferably a group which can be released by any of sulfur, oxygen and nitrogen atoms. There is particularly preferred a group which can be released by sulfur atom described in U.S. Pat. No. 4,351,897 and PCT-WO 88/04795.

In the formula (M-II), $R_{10}$ represents a hydrogen atom or a substituent group; $Y_4$ represents a hydrogen atom or a release group, preferably a halogen atom or an arylthio group; and Za, Zb and Zc each represents methine, a substituted methine, =N— or —NH— and one of Za—Zb bond and Zb—Zc bond is a double bond and the other is a single bond. When Zb—Zc bond is a carbon-to-carbon double bond, the bond may be part of an aromatic ring. A dimer or polymer may be formed by $R_{10}$ or $Y_4$. When Za, Zb or Zc is a substituted methine, a dimer or polymer may be formed by the substituted methine.

Among the magenta couplers, the pyrazoloazole couplers represented by the formula (M-II) are preferred, because they are excellent in color reproduction and scarcely causes stain. Further, among these compounds, there are preferred imidazo[1,2-b] pyrazole compounds described in U.S. Pat. No. 4,500,630, because color forming dyes scarcely have yellow side absorption and they are excellent in fastness to light. Pyrazolo[1,5-b][1,2,4]triazole compounds described in U.S. Pat. No. 4,540,654 are particularly preferred.

There are preferred pyrazolotriazole couplers wherein a branched alkyl group is directly attached to the position 2, 3 or 6 of its pyrazolotriazole ring, described in JP-A-61-65245; pyrazoloazole couplers having a sulfonamido group in the molecular structure described in JP-A-61-65246; pyrazoloazole couplers having an alkoxyphenylsulfonamido ballast group described in JP-A-61-147254; and pyrazoloazole couplers having an alkoxy or aryloxy group at the position 6 thereof described in EP-A-226,849 and EP-A-294,785.

Examples of the couplers represented by the formulae (C-I) to (M-II) include the following compounds.

(C-1)

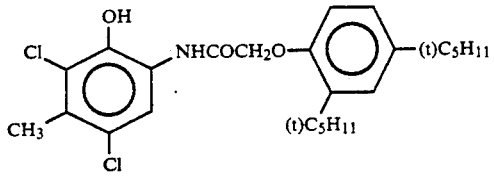

(C-2)

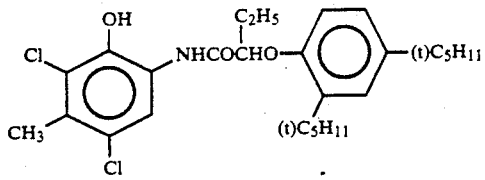

(C-3)

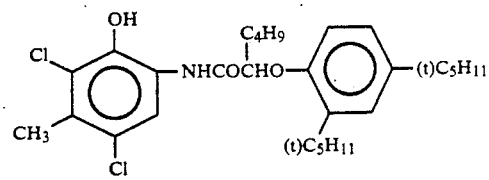

-continued
(C-4)
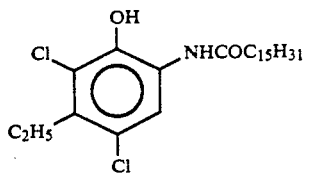
(C-5)
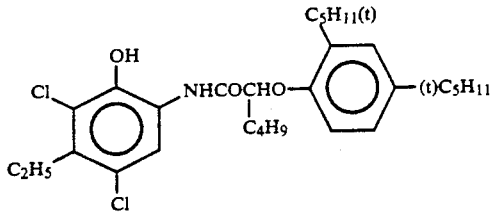
(C-6)
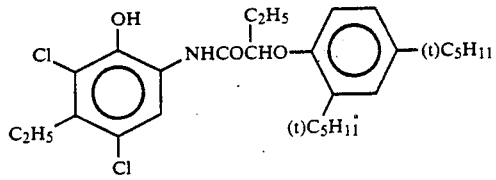
(C-7)
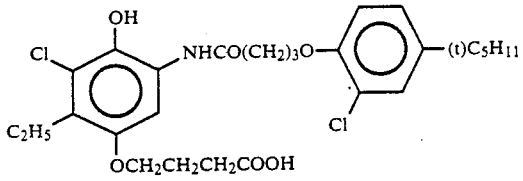
(C-8)
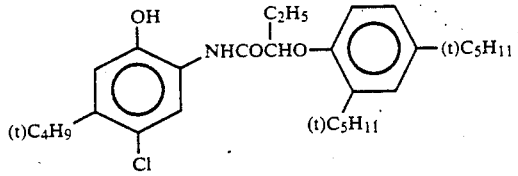
(C-9)
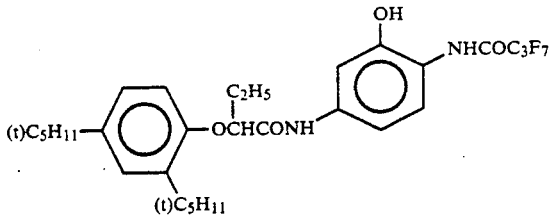
(C-10)
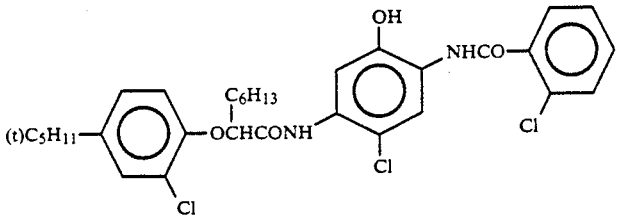

-continued
(C-11)
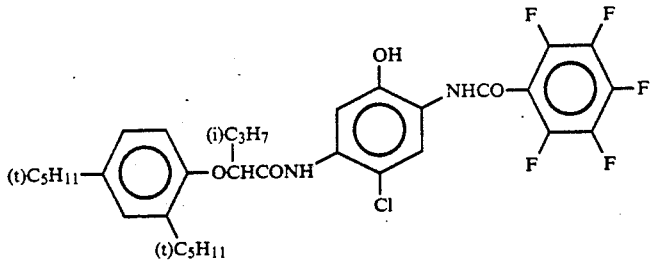
(C-12)
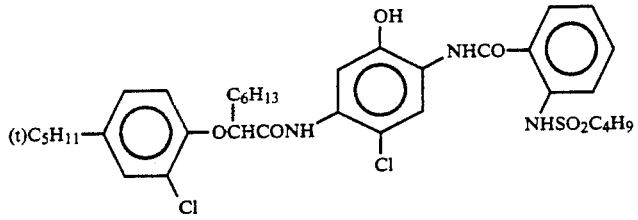
(C-13)
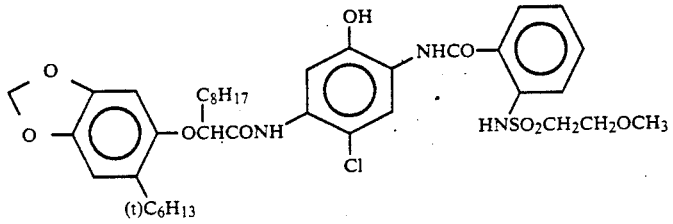
(C-14)
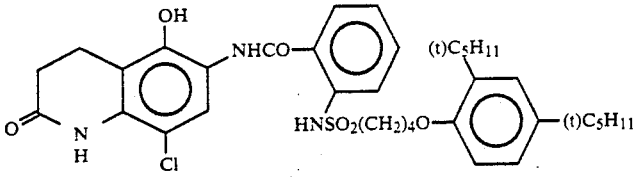
(C-15)
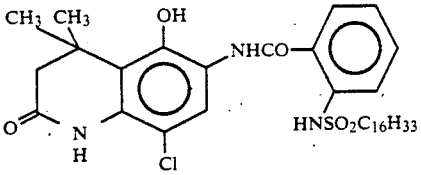
(C-16)
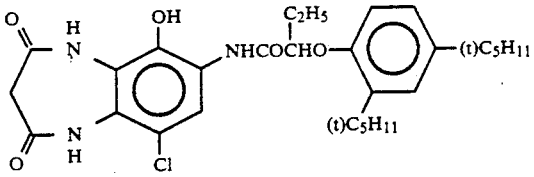
(C-17)
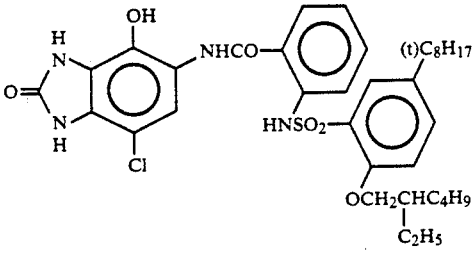

-continued
(C-18)
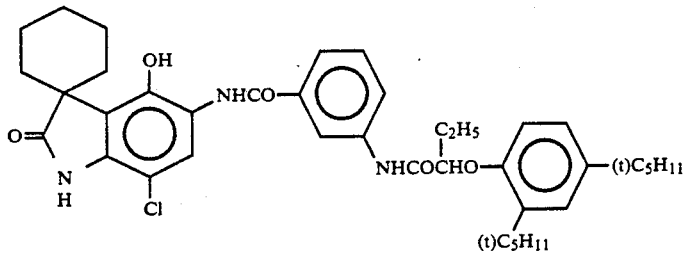
(C-19)
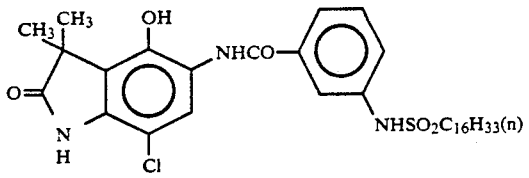
(C-20)
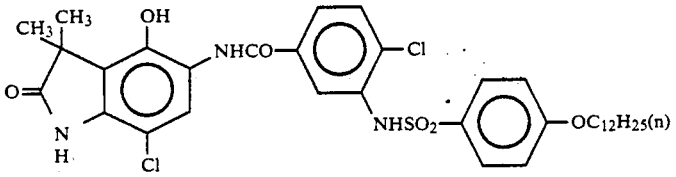
(C-21)
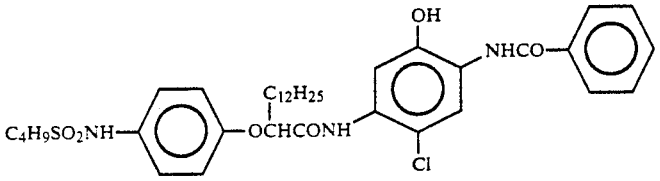
(C-22)
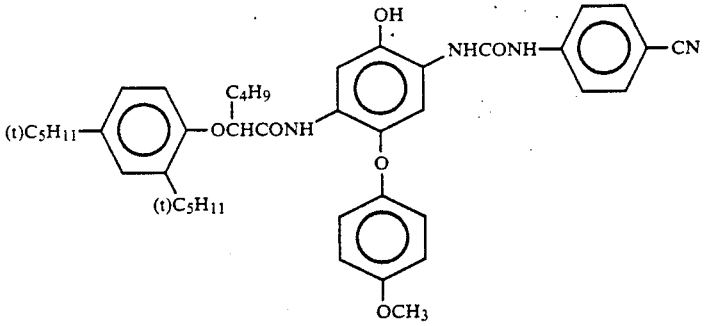
(M-1)
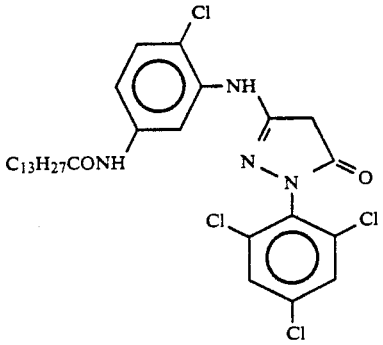

-continued
(M-2)
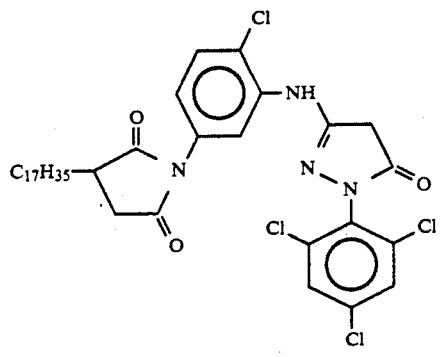
(M-3)
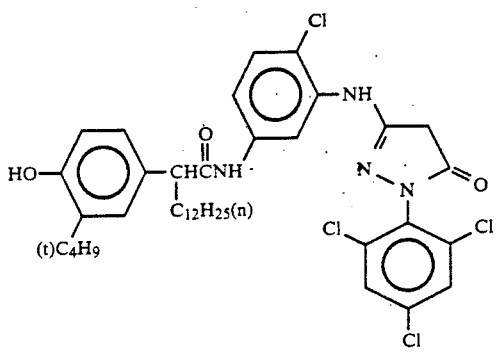
(M-4)
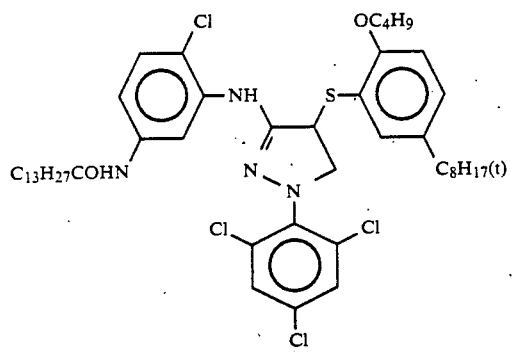
(M-5)
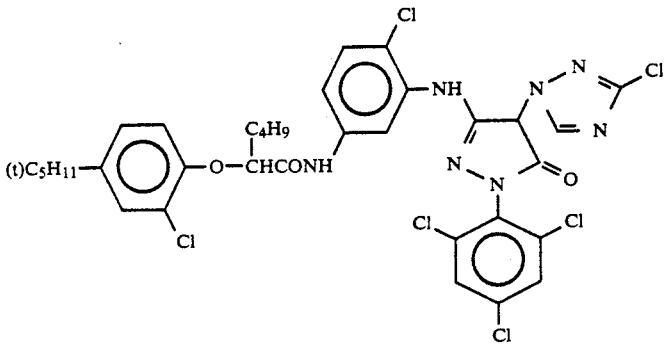

-continued
(M-6)
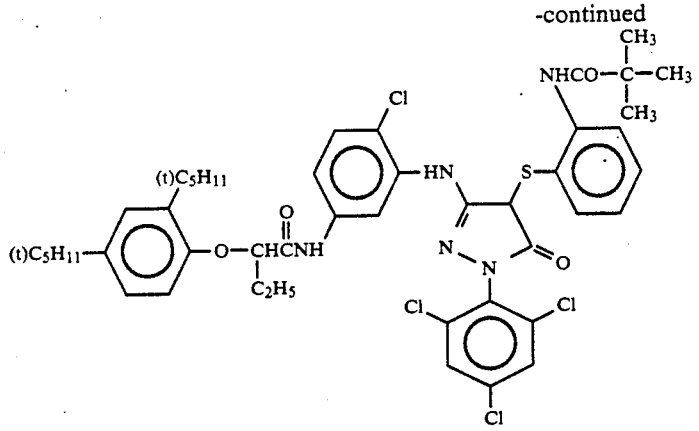
(M-7)
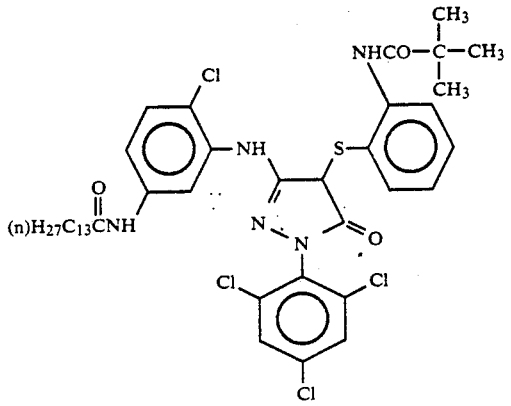
(M-8)
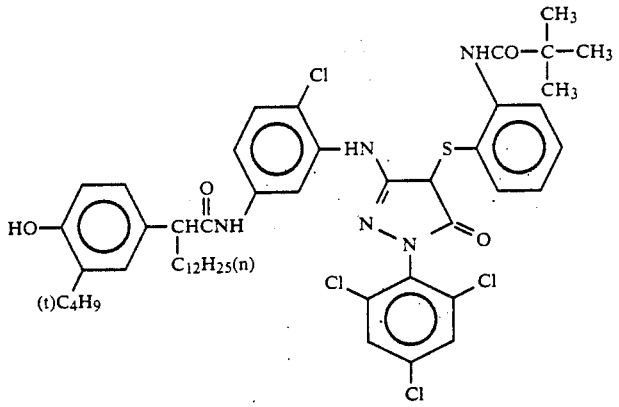

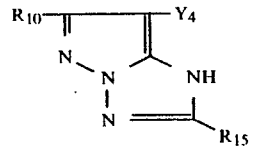
| Compound | $R_{10}$ | $R_{15}$ | $Y_4$ |
|---|---|---|---|
| M-9 | $CH_3$— | 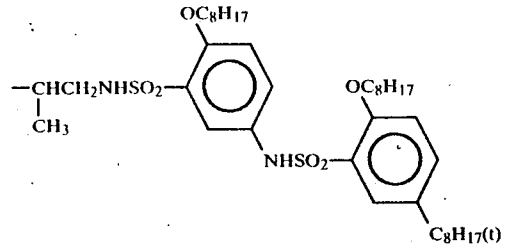 | Cl |
| M-10 | " | 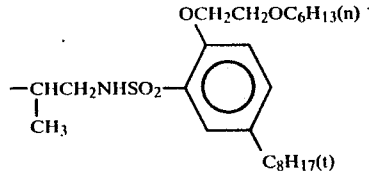 | " |
| M-11 | $(CH_3)_3C$— | 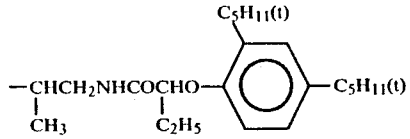 | 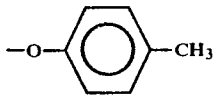 |
| M-12 | 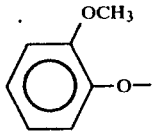 | 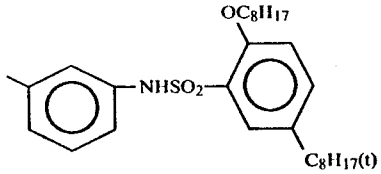 | 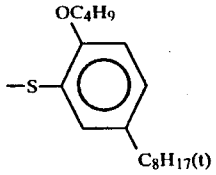 |

-continued
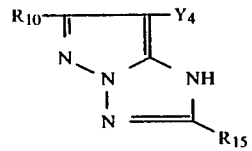
| Compound | $R_{10}$ | $R_{15}$ | $Y_4$ |
|---|---|---|---|
| M-13 | $CH_3$— | 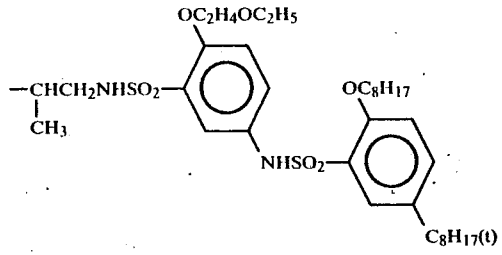 | Cl |
| M-14 | " | 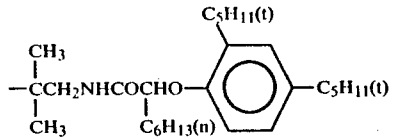 | " |
| M-15 | " | 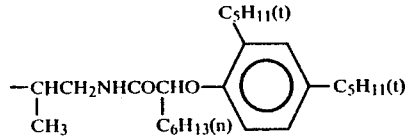 | " |
| M-16 | " | 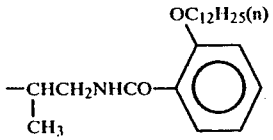 | " |
| M-17 | $CH_3$— | 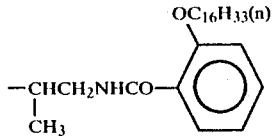 | Cl |

-continued
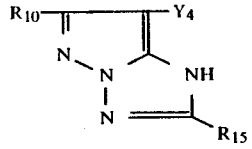
| Compound | $R_{10}$ | $R_{15}$ | $Y_4$ |
|---|---|---|---|
| M-18 | 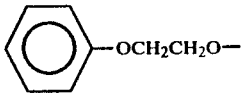 | 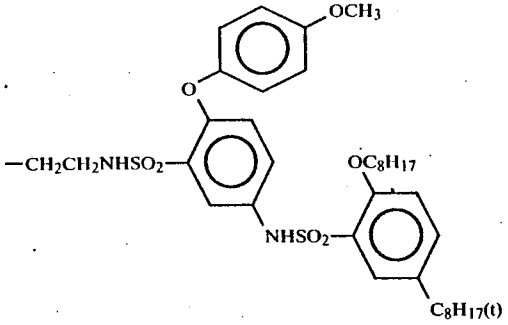 | 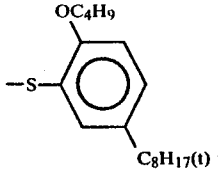 |
| M-19 | $CH_3CH_2O-$ | " | " |
| M-20 | 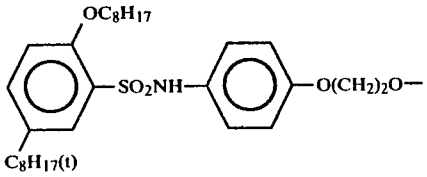 | 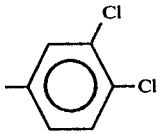 | 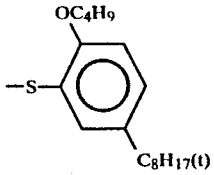 |
| M-21 | 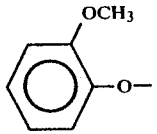 | 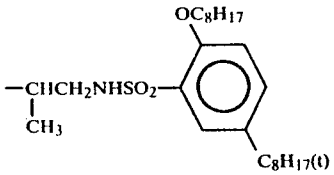 | Cl |
| M-22 | $CH_3-$ | 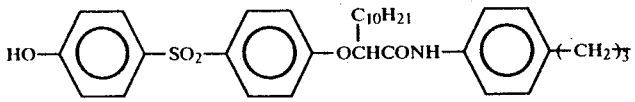 | Cl |

-continued
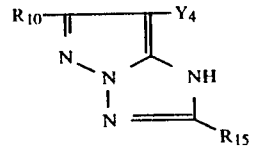
| Compound | $R_{10}$ | $R_{15}$ | $Y_4$ |
|---|---|---|---|
| M-23 | " | $(n)C_6H_{13}$ CHCH$_2$SO$_2$(CH$_2$)$_2$ $(n)C_8H_{17}$ | " |
| M-24 | $CH_3$ CH— $CH_3$ | $OC_4H_9$ $SO_2(CH_2)_3$ $C_8H_{17}(t)$ | " |
| M-25 | $CH_3$ (CH—CH$_2$)$_{50}$ (CH$_2$—C)$_{50}$ $COOCH_2CH_2OCH_3$ CONH— | $CH_3$—CH— $CH_2NHSO_2CH_3$ | " |
| M-26 | —O— | $OC_8H_{17}$ $(CH_2)_2NHSO_2$ $C_8H_{17}(t)$ | Cl |
| M-27 | $CH_3$— | $CH_3$ $CH_3$ $CH_3$ NHCOCHO $(n)C_{10}H_{21}$ $SO_2$ $OCH_2$ | " |

-continued
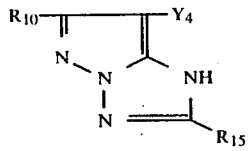
| Compound | $R_{10}$ | $R_{15}$ | $Y_4$ |
|---|---|---|---|
| M-28 | $(CH_3)_3C-$ | 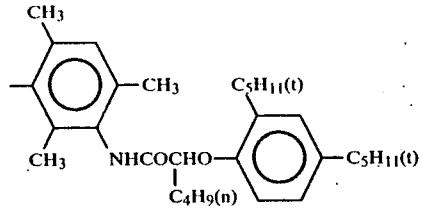 | " |
| M-29 | 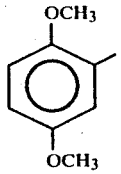 | 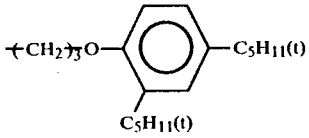 | " |
| M-30 | $CH_3-$ | 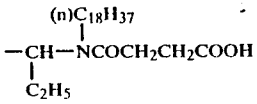 | Cl |

$1\times10^{-3}$ to 1.0 mol, preferably 0.1 to 0.5 mol (per mol of silver halide) of the couplers of the formulae (C-I) to (M-II) is contained in the silver halide emulsion layer constituting the light-sensitive layer of the photographic material.

Said cyan coupler, magenta coupler and yellow coupler can be added to the light-sensitive layer by conventional methods. Generally, the couplers can be added by an oil-in-water dispersion method known as an oil protect method. After the couplers are dissolved in a solvent, the solution is emulsified in an aqueous gelatin solution containing a surfactant. Alternatively, water or an aqueous gelatin solution may be added to a coupler solution containing a surfactant and an oil-in-water dispersion may be formed by phase inversion. Alkali-soluble couplers can be dispersed by Fisher dispersion method. After low-boiling organic solvents are removed from the coupler dispersion by means of distillation, water washing or ultrafiltration, the dispersion may be mixed with the photographic emulsion.

It is preferred that high-boiling organic solvents having a dielectric constant (25° C.) of 2 to 20 (solvents for phenolic cyan couplers having an acylamino group at the position 2 of the phenol nucleus and a C2 or higher alkyl group at the position 5 of the phenol nucleus, have a dielectric constant of preferably 6 or lower) and a refractive index (25° C.) of 1.5 to 1.7 and/or water-insoluble high-molecular compounds are used as dispersion mediums for the couplers.

Preferred examples of the high-boiling organic solvents are the following compounds represented by the following general formulae (A) to (E).

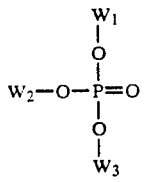
(A)

$W_1-COO-W_2$ (B)

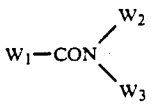
(C)

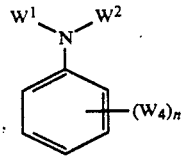
(D)

$W_1-O-W_2$ (E)

In the formulae (A) to (E), $W_1$, $W_2$ and $W_3$ each represents a substituted or unsubstituted alkyl group, a cycloalkyl group, an alkenyl group, an aryl group or a heterocyclic group; $W_4$ represents $W_1$, $OW_1$ or $S-W_1$; and n represents an integer of from 1 to 5, provided that when n is 2 or greater, $W_4$ may be the same or different group. In the formula (E), $W_1$ and $W_2$ may be combined together to form a condensed ring.

In addition to the solvents represented by the formulae (A) to (E), there can be used compounds which have a melting point of not higher than 100° C., but a boiling point of not lower than 140° C. and are water-immiscible and good solvents for the couplers. The melting points of the high-boiling organic solvents are preferably 80° C. or lower. The boiling points thereof are preferably not lower than 160° C., more preferably not lower than 170° C. The high-boiling organic solvents are described in more detail in JP-A-62-215272 (from the lower right column of page 137 of its specification to the upper right column of page 144 thereof).

These couplers are mixed with a latex polymer (e.g., polymer described in U.S. Pat. No. 4,203,776 or EP-A-294104) or are dissolved in a water-insoluble, but organic solvent-soluble polymer in the presence or absence of said high-boiling organic solvent, and then emulsified in an aqueous solution of hydrophilic colloid.

For this purpose, water-insoluble, but organic solvent-soluble homopolymers or copolymers described in PCT WO 88/00723 (pages 12–30 of its specification) are preferred. Acrylamide polymers are particularly preferred from the viewpoint of color image stabilization.

The photographic material of the present invention may contain hydroquinone derivatives, aminophenol derivatives, gallic acid derivatives and ascorbic acid derivatives as antifogging agents.

The photographic material of the present invention may contain various discoloration inhibitors. Typical examples of organic discoloration inhibitors for cyan image, magenta image and/rr yellow image include hindered phenols, hydroquinones, 6-hydroxychromans, 5-hydroxycoumarans, spirochromans, p-alkoxyphenols, bisphenols, gallic acid derivatives, methylenedioxybenzenes, aminophenols, hindered amines and ether or ester derivatives obtained by silylating or alkylating phenolic hydroxyl groups of these compounds. Metal complexes such as (bissalicylaldoximato)nickel complex and (bis-N,N-dialkyldithiocarbamato)nickel complex can be used.

Examples of the organic discoloration inhibitors include those described in the following patent specifications.

Namely, there are hydroquinones in U.S. Pat. Nos. 2,360,290, 2,418,613, 2,700,453, 2,701,197, 2,728,659, 2,732,300, 2,735,765, 3,982,944, 4,430,425, 2,710,801 and 2,816,028 and British Patent 1,363,921; 6-hydroxychromans, 5-hydroxycoumarans and spirochromans in U.S. Pat. Nos. 3,432,300, 3,573,050, 3,574,627, 3,698,909 and 3,764,337, JP-A-52-152225; spiroindanes in U.S. Pat. No. 4,360,589; p-alkoxyphenols in U.S. Pat. No. 2,735,765, British Patent 2,066,975, JP-A-59-10539, JP-B-57-19765; hindered phenols in U.S. Pat. No. 3,700,455, JP-A-52-72224, U.S. Pat. No. 4,228,235, JP-B-52-6623; gallic acid derivatives, methylenedioxybenzenes and aminophenols in U.S. Pat. Nos. 3,457,079, 4,332,886 and JP-B-56-21144; hindered amines in U.S. Pat. Nos. 3,336,135 and 4,268,593, British Patents 1,326,889, 1,354,313 and 1,410,846, JP B-51-1420, JP-A-58-114036, JP-A-59-53846 and JP-A-59-78344; and metal complexes in U.S. Pat. Nos. 4,050,938 and 4,241,155 and British Patent 2,027,731A. Generally, 5 to 100% by weight (based on the amount of the corresponding coupler) of these compounds is coemulsified with the corresponding coupler. The resulting emulsion is added to the light-sensitive layer. It is preferred that an ultraviolet light absorber is added to the cyan color forming layer and both layers adjacent to the cyan color forming layer to prevent cyan color image from being deteriorated by heat and particularly light.

Examples of the ultraviolet absorber include aryl group-substituted benztriazole compounds described in U.S. Pat. No. 3,533,794; 4 thiazolidone compounds described in U.S. Pat. Nos. 3,314,794 and 3,352,681; benzophenone compounds described in JP-A-46-2784; cinnamic ester compounds described in U.S. Pat. Nos. 3,705,805 and 3,707,395; butadiene compounds described in U.S. Pat. No. 4,045,229; and benzoxydole compounds described in U.S. Pat. No. 3,700,455. Ultraviolet absorbing couplers (e.g., α-naphtholic cyan dye forming couplers) and ultraviolet light absorbing polymers may be used. These ultraviolet light absorbers are added to specific layers.

Among them, the aryl group-substituted benzotriazole compounds are preferred.

It is preferred to use the aforesaid couplers, particularly pyrazoloazole couplers, together with the following compounds.

It is preferred to use a compound (F) and/or a compound (G) simultaneously or separately, because stain is prevented from being formed during storage by colored dye formed by the reaction of a coupler with a color developing agent or its oxidation product left in the film after processing and other side reactions can be prevented from taking place, said compound (F) being chemically bonded to the aromatic amine developing agent left after color development processing to form a compound which is chemically inactive and substantially colorless and said compound (G) being chemically bonded to the oxidation product of the aromatic amine developing agent left after color development processing to form a compound which is chemically inactive and substantially colorless.

Preferred examples f the compound (F) are compounds which are reacted with p-anisidine at a rate constant $k_2$ of second-order reaction (in trioctyl phosphate at 80° C.) in the range of from 1.0 l/mol.sec to $1\times10^{-5}$ l/mol.sec. The rate constant of second-order reaction can be measured by the method described in JP-A-63-158545.

When $k_2$ is larger than the upper limit of the range specified above, there is a possibility that the compound itself becomes unstable and is decomposed by the reaction with gelatin or water, while when $k_2$ is smaller than the lower limit, the reaction with the aromatic amine developing agent left is retarded and as a result, there is a fear that the side reaction of the aromatic amine developing agent can not be prevented.

More preferred examples of the compounds (F) include compounds represented by the following general formulae (FI) and (FII).

$$R_1-(A)_n-X \qquad \text{(FI)}$$

$$R_2-\underset{\underset{B}{|}}{C}=Y \qquad \text{(FII)}$$

In the formulae (FI) and (FII), $R_1$ and $R_2$ each represents an aliphatic group, an aromatic group or a heterocyclic group; n represents 1 or 0; A represents a group which is reacted with the aromatic amine developing agent to form a chemical bond; X represents a group which is released by the reaction with the aromatic amine developing agent; B represents a hydrogen atom, an aliphatic group, an aromatic group, a heterocyclic group, an acyl group or a sulfonyl group; Y represents a group which accelerates the addition of the aromatic amine developing agent to the compound having the formula (FII); and $R_1$ and X may be combined together to form a ring, and Y and $R_2$ or B may be combined together to form a ring.

Typical mechanisms of the chemical bonding of the aromatic amine developing agent left are substitution reaction and addition reaction.

Preferred compounds having the formulae (FI) and (FII) are described in JP-A-63-158545, JP-A-62-283338, EP-A-277589 and EP-A-298321.

Preferred examples of the compound (G) which is chemically bonded to the oxidation product of the aromatic amine developing agent left behind after processing to form a compound which is chemically inactive and colorless, include compounds represented by the following formula (GI).

$$R-Z \qquad \text{(GI)}$$

In the formula (GI), R represents an aliphatic group, an aromatic group or a heterocyclic group; and Z represents a nucleophilic group or a group which is decomposed in the photographic material to release a nucleophilic group. Preferred compounds having the formula (GI) are those where Z is a group having a Pearson's nucleophilic $^{n}CH_3I$ value of 5 or higher or a group derived from said group [R. G. Pearson et al., J. Am. Chem. Soc., 90, 319 (1968)].

Preferred compounds having the formula (GI) are described in EP-A-255722, JP-A-62-143048, JP-A-62-229145, Japanese Patent Application Nos. 63-136724 and 62-214681, EP-A-277589 and EP-A-298321.

Combinations of the compounds (G) with the compounds (F) are described in more detail in EP-A-277589.

The hydrophilic colloid layer of the photographic material of the present invention may contain water-soluble dyes as filter dyes or for the purpose of preventing irradiation, etc. Examples of the dyes include oxonol dyes, hemioxonol dyes, styryl dyes, merocyanine dyes, cyanine dyes and azo dyes. Among them, oxonol dyes, hemioxonol dyes and merocyanine dyes are preferred.

Gelatin is preferred as a binder or protective colloid for the emulsion layer of the photographic material of the present invention. However, other hydrophilic colloid alone or together with gelatin can be used.

Any of lime-processed gelatin and acid-processed gelatin can be used in the present invention. The preparation of gelatin is described in more detail in the literature "The Macromolecular Chemistry of Gelatin" (Academic Press, 1964).

As the support of the present invention, there can be used reflection type supports and transparent supports such as cellulose nitrate film and polyethylene terephthalate film which are conventionally used for the photographic materials. For the purpose of the present invention, the reflection type supports are preferred. The term "reflection type support" as used herein refers to a support whose reflection properties are enhanced to thereby make a color image clear, said color image being formed on the silver halide emulsion layer. The reflection type supports are formed by coating a support with a hydrophobic resin containing a light-reflecting material such as titanium oxide, zinc oxide, calcium carbonate or calcium sulfate. Hydrophobic resins containing a light-reflective material themselves can also be used as the reflection type supports. For example, baryta paper, polyethylene-coated paper, synthetic polypropylene paper, transparent supports provided with a reflection layer and transparent supports containing a reflecting material can be used as supports. Examples of the transparent supports include glass plate, polyester films such as polyethylene terephthalate film, cellulose triacetate film and cellulose nitrate film, polyamide films, polycarbonate films, polystyrene films and vinyl chloride resin films.

Other reflection type supports include supports having a metallic surface having specular reflection properties or diffuse reflection properties of the second kind. Metallic surfaces having a spectral reflectance of not lower than 0.5 in the region of visible light are preferred. It is preferred that diffuse reflection properties are imparted to the metallic surfaces by roughening the surfaces or treating them with metallic powder. Examples of metals include aluminum, tin, silver, magnesium and alloys thereof. The surfaces of metallic plates, metallic foils or thin metallic layers are subjected to rolling, metallizing or plating. Among the, metallic surfaces formed by metallizing substrates are preferred. It is preferred that a water-resistant resin layer, particularly a thermoplastic resin layer is provided on the metallic surface. It is preferred that an antistatic layer is provided on the side of the support, said side being opposed to the metallic surface side of the support. Such supports are described in more detail in JP-A-61-210346, JP-A 63-24247, JP-A-63-24251 and JP-A 63-24255. These supports are properly chosen according to the purpose of use.

It is preferred that white pigments as light reflecting materials are thoroughly kneaded in the presence of a surfactant. It is also preferred that the surfaces of pigment particles are treated with dihydric to tetrahydric alcohols.

Occupation area ratio per unit area of fine white pigment particles can be determined by dividing the most typically observed area into unit areas of 6 $\mu m \times 6$ $\mu m$ which unit areas are bordered one another and measuring the occupation area ratio (%) (Ri) of the fine particles projected on the unit areas. The coefficient of variation of the occupation area ratio (%) can be determined by the ratio ($s/\overline{R}$) of the standard deviation s of Ri to the mean value ($\overline{R}$) of Ri. The number (n) of unit areas is preferably 6 or greater. The coefficient of variation $s/\overline{R}$ can be determined by the following formula.

$$\sqrt{\frac{\sum_{i=1}^{n}(R_i - R)^2}{n-1}} \Big/ \frac{\sum_{i=1}^{n} R_i}{n}$$

In the present invention, the coefficient of variation of the occupation area ratio (%) of the fine pigment particles is preferably not higher than 0.15, particularly preferably not higher than 0.12. When the coefficient of variation is 0.08 or below, the dispersibility of the particles is considered to be substantially uniform.

Color developing solutions which are used for the development of the photographic materials of the present invention are preferably aqueous alkaline solutions mainly composed of aromatic primary amine color developing agents. Though aminophenol compounds can be used as the color developing agents, p-phenylenediamine compounds are preferred. Typical examples thereof include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-62-methoxyethylaniline and their sulfates, their hydrochlorides and their p-toluenesulfonates. These compounds may be used either alone or in a combination of two or more of them.

Generally, the color developing solutions contain pH buffering agent such as alkali metal carbonates, borates or phosphates, anti-fogging agent or development inhibitor such as bromides, iodides, benzimidazoles, benzthiazoles or mercapto compounds, etc. If desired, the developing solutions may contain preservative such as hydroxylamine, diethylhydroxylamine, hydrazine sulfites, phenylsemicarbazides, triethanol amine, catechol sulfonate and triethylenediamine(1,4-diazabicyclo[2,2,-2]octane); organic solvent such as ethylene glycol and diethylene glycol; development accelerator such as benzyl alcohol, polyethylene glycol, quaternary ammonium salts and amines; color forming coupler; competitive coupler; fogging agent such as a sodium boron hydride; auxiliary developing agent such as 1-phenyl-3-pyrazolidone; tackifier; chelating agent such as aminopolycarboxylic acids, aminopolyphosphonic acids, alkylphosphonic acids and phosphonocarboxylic acids, etc. Typical examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediaminedi(o-hydroxyphenylacetic acid) and salts thereof.

When reversal development is carried out, color development is conducted generally after black-and-white development. Black-and-white developing solutions may contain one or more of conventional black-and-white developing agents such as dihydroxybenzenes (e.g., hydroquinone), 3-pyrazolidones (e.g., 1-phenyl-3-pyrazolidone) and aminophenols (e.g., N-methyl-p-aminophenol).

Generally, the pH values of the color developing solutions and the black-and-white developing solutions are in the range of 9 to 12. The replenishment rates of these developing solutions vary depending on the color photographic materials to be processed, but are generally not more than 3 l per $m^2$ of the photographic material. The replenishment rate can be reduced to 500 ml or less, when bromide ion concentration in the replenisher is reduced. It is preferred that when the amount of the replenisher is reduced, the contact area thereof with air in the processing tank is reduced to thereby prevent the solution from being evaporated and oxidized by air. The amount of the replenisher can be reduced by providing a means for inhibiting the accumulation of the bromide ion in the developing solution.

After color development, photographic emulsion layer is generally bleached. The bleaching may be carried out simultaneously with fixing (bleaching fixing processing). The bleaching may be separately carried out. Further, bleaching-fixing processing may be conducted after bleaching. Processing may be conducted through a bleaching fixing bath composed of two consecutive tanks. Fixing may be conducted before bleaching-fixing processing. Bleaching may be conducted after bleaching-fixing processing. As the bleaching agent, there can be used compounds of polyvalent metals such as iron(III), cobalt(III), chromium(VI) and copper(II), peracids, quinones and nitro compounds. Typical bleaching agents include ferricyanides; dichromates; organic complex salts of iron(III) and cobalt(III) such as complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid and complex salts of citric acid, tartaric acid and malic acid; persulfates; bromates; permanganates; and nitrobenzenes. Among them, persulfates and iron(III) complex salts of amino polycarboxylic acids such as (ethylenediaminetetraactato)iron(III) complex salt are preferred from the viewpoints of rapid processing and prevention of environmental pollution. Further, iron(III) complex salts of aminopolycarboxylic acids are useful for both the bleaching solution and the bleaching-fixing solution. The pH values of the bleaching solution containing said iron(III) complex salts of aminopolycarboxylic acids and the bleaching-fixing solution containing said iron(III) complex salts of aminopolycarboxylic acids are generally in the range of 5.5 to 8. However, the pH value may be more lower to expedite the processing.

The bleaching solution, the bleaching-fixing solution and the previous bath may optionally contain bleaching accelerators. Examples of the bleaching accelerators include compounds having mercapto group or disulfide bond described in U.S. Pat. No. 3,893,858, West German Patent 1,290,812, JP-A-53-95630 and *Research Disclosure* No. 17,129 (July, 1978); thiazolidine derivatives described in JP-A-50-140129; thiourea derivatives described in U.S. Pat. No. 3,706,561; iodide salts described in JP-A-58-16235; polyoxyethylene compounds described in West German Patent 2,748,430; polyamine compounds described in JP-B-45-8836; and bromide ion. Among them, the compounds having mercapto group or disulfide bond are preferred from the viewpoint of high accelerating effect. Particularly, the compounds described in U.S. Pat. No. 3,893,858, West German Patent 1,290,812 and JP-A-53-95630 are preferred. Further, the compounds described in U.S. Pat. No. 4,552,834 are preferred. These bleaching accelerators may be added to the photographic materials. They are particularly effective, when the color photographic materials for photographing are bleach-fixed.

Examples of fixing agents include thiosulfates, thiocyanates, thioether compounds, thioureas and iodide salts. Thiosulfates are usually used and ammonium thiosulfate can be widely used. Preferred preservatives for the bleaching-fixing solution are sulfites, bisulfites and carbonyl bisulfite adducts.

After desilverization, the silver halide color photographic material of the present invention is subjected to water washing stage and/or stabilization stage. The replenishment rate of the present invention in the water washing stage and/or the stabilizing stage is so set that the rate is from 0.5 to 50 times, preferably 5 to 30 times the amount carried over (brought over) from the previous bath. The amount carried over (brought over) from the previous bath varies depending on the physical properties of the film of the photographic material, squeezing rate, processing rate, etc., but is practically from 20 to 100 ml/m$^2$. The processing system of the water washing stage and/or the stabilizing stage is preferably a multi-stage countercurrent system, particularly two- to six-stage countercurrent system for the purpose of reducing the replenishment rate. The preferred replenishment rate in this system is from about 50 to about 500 ml per m$^2$ of the photographic material. A less replenishment rate is preferred, because running cost and the discharging amount are reduced. However, there are caused problems that bacteria are grown and the resulting suspended matters are deposited on the photographic material, because the residence time of water in the tank is prolonged, though the amount of washing water in the multi-stage countercurrent system can be greatly reduced. A method for reducing calcium ion and magnesium ion described in JP-A-62-288838 can be effectively utilized in the processing of the color photographic material of the present invention to solve the above-described problems. Further there can be used chlorine-containing germicides such as isothiazolone compounds, thiabendazoles and sodium chlorinated isocyanurate and benzotriazole described in JP-A-57-8542; and germicides described in *Antibacterial and Antifungal Chemistry*, written by Hiroshi Horiguchi (published by Sankyo Shuppan 1986), *Sterilization, Germicidal and Antifungal Technique of Microorganism*, (edited by Eisei Gijutsu Kai, published by Kogyo Gijutsu Kai 1982) and *Antibacterial and Antifungal Encyclopedia* (edited by Nippon Bokin Bobai Gakkai, 1986).

The pH of washing water in the processing of the photographic material of the present invention is from 4 to 9, preferably from 5 to 8. The temperature of washing water and washing time vary depending on the characteristics and use of the photographic material. Generally, water washing is carried out at 15° to 45° C. for 20 seconds to 10 minutes, preferably at 25° to 40° C. for 30 seconds to 5 minutes. If desired, the photographic material of the present invention may be treated directly with a stabilizing solution in place of washing water. The stabilizing treatment can be carried out by conventional methods described in JP-A-57-8543, JP-A-58-14834 and JP-A-60-220345.

If desired, further the stabilization stage subsequent to said water washing stage may be carried out. In such a case, the stabilization stage is used as the final bath for the color photographic material for photographing. An example of the bath is a stabilization bath containing formalin and a surfactant. The stabilization bath may contain chelating agents and mildewproofing agents.

Over-flow solution resulting from the replenishment of washing solution and/or stabilizing solution can be re-used in other stages such as the desilverization stage.

The color developing agents may be incorporated in the silver halide color photographic material of the present invention to simplify and expedite the processing. For this purpose, it is preferred to use the precursors of the color developing agents. Examples of the precursors include indoaniline compounds described in U.S. Pat. No. 3,342,597; Schiff base type compounds described in U.S. Pat. No. 3,342,599 and *Research Disclosure* Nos. 14,850 and 15,159; aldol compounds described in Research Disclosure No. 13,924; metal complexes described in U.S. Pat. No. 3,719,492; and urethane compounds described in JP-A-53-135628.

If desired, 1-phenyl-3-pyrazolidone compounds may be incorporated in the silver halide color photographic material of the present invention to accelerate color development. Typical examples of said compounds are described in JP-A-56-64339, JP-A-57-144547 and JP-A-58-115438.

In the present invention, various processing solutions are used at a temperature of 10 to 50° C. Usually, the processing temperature is 33 to 38° C. However, higher temperatures may be used to accelerate processing and to shorten the processing time, or lower temperature may be used to improve the quality of image or to improve the stability of the processing solutions. If desired, processing using cobalt intensification or hydrogen peroxide intensification described in West German Patent 2,226,770 or U.S. Pat. No. 3,674,499 may be carried out to save the amount of silver in the photographic material.

The present invention can be applied to any of processing stages, so long as color developing solutions are used in said processing stages. For example, the present invention can be used in the processing of color paper, color reversal paper, color direct positive photographic material, color positive film, color negative film, color reversal film, etc. The application of the present invention to color paper and color reversal paper is particularly preferred.

The present invention is now illustrated in greater detail by reference to the following examples which, however, are not to be construed as limiting the present invention in any way. The percentages hereafter are by weight unless otherwise indicated.

EXAMPLE 1

The following layers were provided on the surface of a paper support, onto both sides of which polyethylene was laminated, to prepare a silver halide photographic material A having a multi-layer structure. Coating solutions were prepared in the following manners.

Preparation of Coating Solution for First Layer 27.2 cc of ethyl acetate and 7.7 cc (8.0 g) of a high-boiling solvent (Solv-1) were added to 10.2 g of yellow coupler Y-6 and 9.1 g of yellow coupler Y-7 and they were dissolved. The resulting solution was emulsified and dispersed in 185 cc of a 10% aqueous gelatin solution containing 8 cc of a 10% aqueous sodium dodecylbenzenesulfonate solution. The resulting emulsion and Emulsions EM1 and EM2 were mixed and dissolved. The concentration of gelatin was adjusted so as to give the following composition, thus preparing a coating solution for the first layer. In the same way as in the preparation of the coating solution for the first layer, coating solutions for second layer to seventh layer were prepared. There was used sodium salt of 1-oxy-3,5-dichloro-s-triazine as a hardener for gelatin in each layer. Cpd-2 was used as a thickener.

Layer Structure

Each layer has a composition described below. Numerals represent coating weights (g/m$^2$). Silver halide emulsions are expressed by coating weights in terms of silver.

Support

Polyethylene-laminated paper (white pigment ($TiO_2$) and a bluish dye were contained in polyethylene of the side of the first layer)

| | |
|---|---|
| First Layer: Blue-sensitive Layer | |
| Monodisperse silver chlorobromide emulsion (EM1) spectral-sensitized by sensitizing dye (ExS-1) | 0.13 |
| Monodisperse silver chlorobromide emulsion (EM2) spectral-sensitized by sensitizing dye (ExS-1) | 0.13 |

-continued

| | |
|---|---|
| Gelatin | 1.86 |
| Yellow coupler Y-6 | 0.44 |
| Yellow coupler Y-7 | 0.39 |
| Solvent (Solv-1) | 0.35 |
| Second Layer: Antistain Layer | |
| Gelatin | 0.99 |
| Antistain agent (Cpd-3) | 0.08 |
| Third Layer: Green-sensitive Layer | |
| Monodisperse silver chlorobromide emulsion (EM3) spectral-sensitized by sensitizing dyes (ExS-2, 3) | 0.05 |
| Monodisperse silver chlorobromide emulsion (EM4) spectral-sensitized by sensitizing dyes (ExS-2, 3) | 0.11 |
| Gelatin | 1.80 |
| Magenta coupler (ExM-1) | 0.39 |
| Color image stabilizer (Cpd-4) | 0.20 |
| Solvent (Solv-2) | 0.12 |
| Solvent (Solv-3) | 0.25 |
| Fourth Layer: Ultraviolet Light Absorbing Layer | |
| Gelatin | 1.60 |
| Ultraviolet light absorber (ratio of Cpd-7/Cpd-8/Cpd-9 = 3/2/6 by weight) | 0.70 |
| Antistain agent (Cpd-10) | 0.05 |
| Solvent (Solv-4) | 0.27 |
| Fifth Layer: Red-sensitive Layer | |
| Monodisperse silver chlorobromide emulsion (EM5) spectral-sensitized by sensitizing dyes (ExS-4, 5) | 0.07 |
| Monodisperse silver chlorobromide emulsion (EM6) spectral-sensitized by sensitizing dyes (ExS-4, 5) | 0.16 |
| Gelatin | 0.92 |
| Cyan coupler (ExC-1) | 0.32 |
| Color image stabilizer (ratio of Cpd-8/Cpd-9/Cpd-12 = 3/4/2 by weight) | 0.17 |
| Polymer (Cpd-11) for dispersion | 0.28 |
| Solvent (Solv-2) | 0.20 |
| Sixth Layer: Ultraviolet Light Absorbing Layer | |
| Gelatin | 0.54 |
| Ultraviolet light absorber (ratio of Cpd-7/Cpd-9/Cpd-12 = 1/5/3 by weight) | 0.21 |
| Solvent (Solv-2) | 0.08 |
| Seventh Layer: Protective Layer | |
| Gelatin | 1.33 |
| Acrylic-modified copolymer of polyvinyl alcohol (degree of modification = 17%) | 0.17 |
| Liquid paraffin | 0.03 |

There were used Cpd-13 and Cpd-14 as irradiation-inhibiting dyes. Further Alkanol XC (DuPont), sodium alkylbenzenesulfonates, succinic ester and Megafac F-120 (Dainippon Ink & Chemicals Inc.) were used as emulsion dispersants and coating aids for each layer. There were used Cpd-15, Cpd-16, Cpd-17 and Cpd-18 as stabilizers for silver halides.

The emulsions used had the following properties.

| Emulsion | Shape | Grain Size | Br Content (mol %) | Coefficient of Variation |
|---|---|---|---|---|
| EM1 | cube | 1.0 | 80 | 0.08 |
| EM2 | cube | 0.75 | 80 | 0.07 |
| EM3 | cube | 0.5 | 83 | 0.09 |
| EM4 | cube | 0.4 | 83 | 0.10 |
| EM5 | cube | 0.5 | 73 | 0.09 |
| EM6 | cube | 0.4 | 73 | 0.10 |

The following compounds were used for the abovedescribed layers.

ExM-1
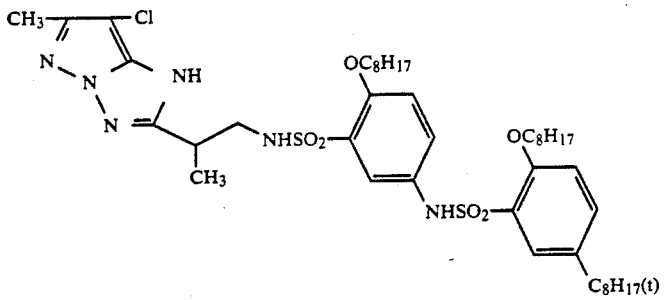
ExC-1
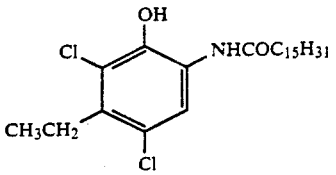
ExS-1
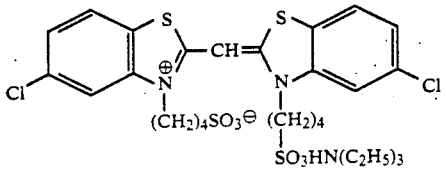
$6 \times 10^{-4}$ mol/mol of Ag
ExS-2
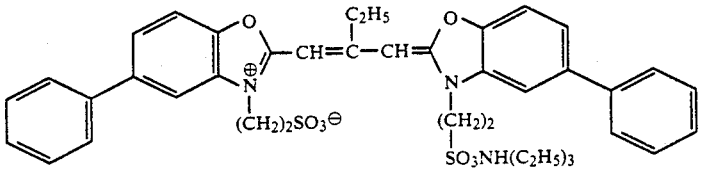
$4 \times 10^{-4}$ mol/mol of Ag
ExS-3
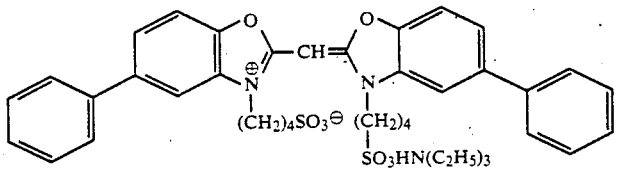
$8 \times 10^{-5}$ mol/mol of Ag
ExS-4
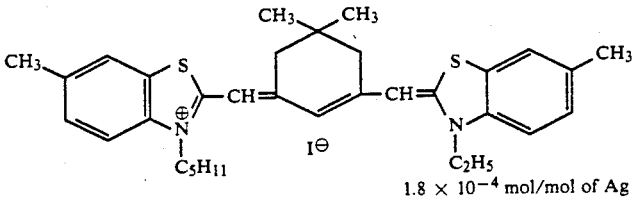
$1.8 \times 10^{-4}$ mol/mol of Ag
ExS-5
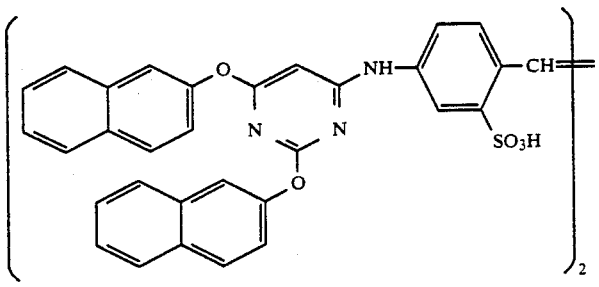

-continued
Cpd-2
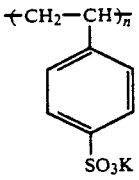
Cpd-3
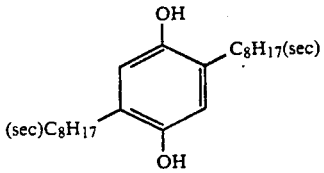
Cpd-4
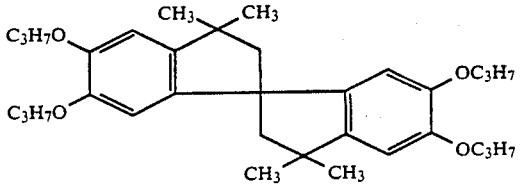
Cpd-7
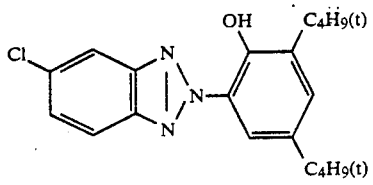
Cpd-8
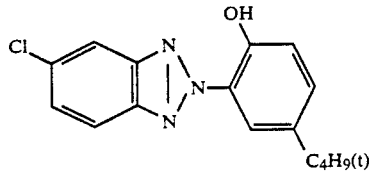
Cpd-9
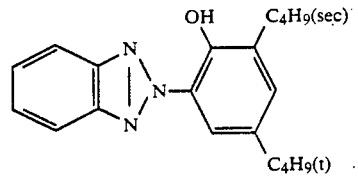
Cpd-10
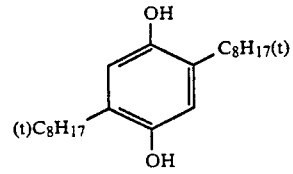
Cpd-11
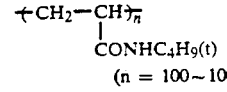
Cpd-12
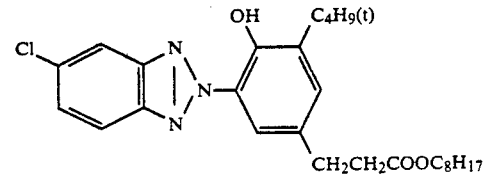
Dibutyl phthalate — Solv-1
Tricresyl phosphate — Solv-2

-continued

Trioctyl phosphate — Solv-3

Trinonyl phosphate — Solv-4

Cpd-13

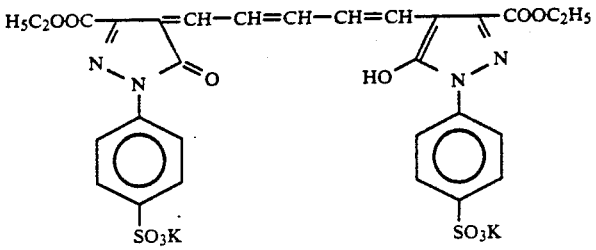

Cpd-14

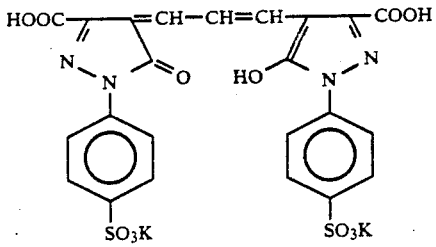

Cpd-15

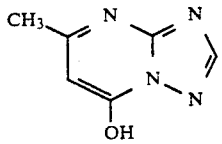

Cpd-16

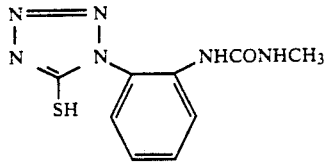

Cpd-17

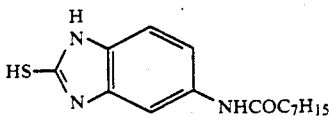

Cpd-18

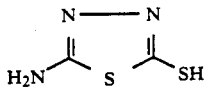

The procedure of the preparation of the photographic material A was repeated except that equimolar amounts of yellow couplers given in Table 1 were used in place of the yellow couplers (the sum of Y-6 and Y-7) in the first layer of the photographic material, or further 50 mol % (based on the amounts of the couplers) of the compounds having the formula (A-I) of the present invention was added to prepare photographic materials B to R.

After the photographic materials were imagewise exposed, continuous processing (running test) was conducted by using Fugi color paper processor PP600 until the amount of replenisher reached twice as much as the capacity of tank for color development in the following processing stages.

| Processing Stage | Temperature (°C.) | Time (sec) | Replenishment Rate* (ml) | Capacity of Tank (l) |
|---|---|---|---|---|
| Color Development | 38 | 100 | 290 | 17 |
| Bleaching-Fixing | 33 | 60 | 150 | 9 |
| Rinse (1) | 30–34 | 20 | — | 4 |
| Rinse (2) | 30–34 | 20 | — | 4 |
| Rinse (3) | 30–34 | 20 | 364 | 4 |
| Drying | 70–80 | 50 | | |

*per $m^2$ or photographic material.
(Three tank countercurrent system from Rinse (3) to Rinse (1).)

Each processing solution had the following composition.

| | Tank Solution | Replenisher |
|---|---|---|
| Color Developing Solution | | |
| Water | 800 ml | 800 ml |
| Diethylenetriamine-pentaacetic acid | 1.0 g | 1.0 g |
| Nitrilotriacetic acid | 2.0 g | 2.0 g |
| 1-Hydroxyethylidene-1,1 di-phosphonic acid | 2.0 g | 2.0 g |
| Benzyl alcohol | 16 ml | 22 ml |
| Diethylene glycol | 10 ml | 10 ml |
| Sodium sulfite | 2.0 g | 2.5 g |
| Potassium bromide | 0.5 g | — |
| Potassium carbonate | 30 g | 30 g |
| N-Ethyl-N-(β-methanesulfon-amidoethyl)-3-methyl-4-aminoaniline sulfate | 5.5 g | 7.5 g |
| Hydroxylamine sulfate | 2.0 g | 2.5 g |
| Brightening agent (Whitex 4B, Sumitomo Chemical Co., Ltd.) | 1.5 g | 2.0 g |
| Water to make up to | 1000 ml | 1000 ml |
| pH (25° C.) | 10.20 | 10.60 |
| Bleaching-Fixing Solution | | |
| Water | 400 ml | 400 ml |
| Ammonium thiosulfate (70%) | 200 ml | 300 ml |
| Sodium sulfite | 20 g | 40 g |
| Ammonium ethylenediamine-tetraacetato ferrate | 60 g | 120 g |
| Disodium ethylenediamine-tetraacetate | 5 g | 10 g |
| Water to make up to | 1000 ml | 1000 ml |

-continued

| | Tank Solution | Replenisher |
|---|---|---|
| pH (25° C.) | 6.70 | 6.30 |

Rinsing Solution

Ion-exchanged water (content of each of calcium and magnesium being not higher than 3 ppm).

Photographic characteristics were expressed by minimum density (Dmin) and maximum density (Dmax).

1. Fasteness test to light and 2. stability test to moisture and heat were carried out as image fastness test. Perhaps test to light was conducted by using Xenon Fade Meter (90000 lux) under such conditions that irradiation time was 200 hours. Test results were expressed by the ratio (percentage) of density after test to color density 2.0 before test.

Stability test to moisture and heat was conducted by allowing samples to stand at 80° C. and RH of 70% for 15 days. Test results were expressed by the ratio (percentage) of density after test to color density (1.50 before test.

Results are shown in Table 1.

TABLE 1

| Photographic Material | Yellow Coupler | Compound of Formula (A-I) of Invention | Photographic Characteristics $D_{min}$ | Photographic Characteristics $D_{max}$ | Fastness to Light (%) | Fastness to Moisture and Heat (%) | Remarks |
|---|---|---|---|---|---|---|---|
| A | Y-6/Y-7 | — | 0.13 | 2.21 | 66 | 65 | Comparative Ex. |
| B | R-1 | — | 0.19 | 1.97 | 60 | 55 | Comparative Ex. |
| C | R-1 | A-7 | 0.17 | 1.95 | 77 | 70 | Comparative Ex. |
| D | R-1 | A-8 | 0.16 | 1.95 | 81 | 66 | Comparative Ex. |
| E | Y-6/Y-7 | A-7 | 0.15 | 2.19 | 86 | 85 | Present Invention |
| F | Y-6/Y-7 | A-9 | 0.13 | 2.21 | 85 | 86 | Present Invention |
| G | Y-6/Y-7 | A-21 | 0.12 | 2.22 | 86 | 84 | Present Invention |
| H | Y-6/Y-7 | A-25 | 0.11 | 2.20 | 88 | 87 | Present Invention |
| I | Y-6/Y-7 | A-47 | 0.13 | 2.19 | 85 | 88 | Present Invention |
| J | Y-6/Y-7 | A-51 | 0.11 | 2.20 | 88 | 87 | Present Invention |
| K | Y-6/Y-7 | A-63 | 0.12 | 2.21 | 91 | 90 | Present Invention |
| L | Y-6 | A-8 | 0.13 | 2.21 | 87 | 85 | Present Invention |
| M | Y-6 | A-7 | 0.12 | 2.18 | 85 | 86 | Present Invention |
| N | Y-6 | A-8 | 0.12 | 2.19 | 84 | 85 | Present Invention |
| O | Y-22 | A-20 | 0.13 | 2.20 | 87 | 86 | Present Invention |
| P | Y-28 | A-29 | 0.11 | 2.22 | 88 | 88 | Present Invention |
| R | Y-28 | A-25 | 0.12 | 2.25 | 87 | 86 | Present Invention |

It is apparent from Table 1 that the photographic materials containing the yellow couplers of the present invention and the compounds of the present invention retain high color formability and have greatly improved image fastness as well.

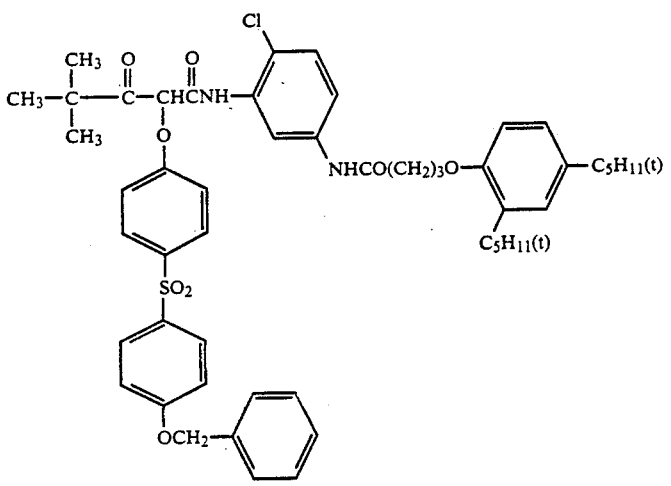

(R-1)

EXAMPLE 2

The following layers were provided on the surface of a paper support, onto both sides of which polyethylene was laminated, to prepare a multi-layer silver halide photographic material A. Coating solutions were prepared in the following manners.

Preparation of Coating Solution for First Layer 27.2 cc of ethyl acetate and 7.7 cc (8.0 g) of a high-boiling solvent (Solv-1) were added to 19.1 g of yellow coupler Y-7 and the mixture was dissolved. The resulting solution was emulsified and dispersed in 185 cc of a 10% aqueous solution of gelatin containing 8 cc of a 10% aqueous solution of sodium dodecylbenzenesulfonate. The resulting emulsified dispersion and emulsions EM7 and EM8 were mixed and dissolved. The concentration of gelatin was adjusted so as to give the following composition, thus preparing a coating solution for the first layer. In the same way as in the preparation of the coating solution for the first layer, coating solutions for second layer to seventh layer were prepared. There was used sodium salt of 1-oxy-3,5-dichloro-s-triazine as a hardener for gelatin in each layer. There was used Cpd-2 as a thickener.

Layer Structure

Each layer has a composition described below. Numerals represent coating weights (g/m$^2$). Silver halide emulsions are expressed by coating weights in terms of silver.

Support

Polyethylene-laminated paper (white pigment ($TiO_2$) and a bluish dye were contained in polyethylene on the side of the first layer).

| | |
|---|---|
| First Layer: Blue-Sensitive Layer | |
| Monodisperse silver chlorobromide emulsion (EM7) spectral-sensitized by sensitizing dye (ExS-1) | 0.15 |
| Monodisperse silver chlorobromide emulsion (EM8) spectral-sensitized by sensitizing dye (ExS-1) | 0.15 |
| Gelatin | 1.86 |
| Yellow coupler Y-7 | 0.82 |
| Solvent (Solv-1) | 0.35 |
| Second Layer: Antistain Layer | |
| Gelatin | 0.99 |

-continued

| | |
|---|---|
| Antistain agent (Cpd-3) | 0.08 |
| Third Layer: Green-Sensitive Layer | |
| Monodisperse silver chlorobromide emulsion (EM9) spectral-sensitized by sensitizing dyes (ExS-2, 3) | 0.12 |
| Monodisperse silver chlorobromide emulsion (EM10) spectral-sensitized by sensitizing dyes (ExS-2, 3) | 0.24 |
| Gelatin | 1.24 |
| Magenta coupler (ExM-1) | 0.39 |
| Color image stabilizer (Cpd-4) | 0.25 |
| Color image stabilizer (Cpd-5) | 0.12 |
| Solvent (Solv-2) | 0.25 |
| Fourth Layer: Ultraviolet Light Absorbing Layer | |
| Gelatin | 1.60 |
| Ultraviolet light absorber (ratio of Cpd-6/Cpd-7/Cpd-8 = 3/2/6 by weight) | 0.70 |
| Antistain agent (Cpd-9) | 0.05 |
| Solvent (Solv-3) | 0.42 |
| Fifth Layer: Red-Sensitive Layer | |
| Monodisperse silver chlorobromide emulsion (EM11) spectral-sensitized by sensitizing dyes (ExS-4, 5) | 0.07 |
| Monodisperse silver chlorobromide emulsion (EM12) spectral-sensitized by sensitizing dyes (ExS-4, 5) | 0.16 |
| Gelatin | 0.92 |
| Cyan coupler (ExC-1) | 0.15 |
| Cyan coupler (ExC-2) | 0.18 |
| Color image stabilizer (ratio of Cpd-7/Cpd-8/Cpd-10 = 3/4/2 by weight) | 0.17 |
| Polymer (Cpd-11) for dispersion | 0.14 |
| Solvent (Solv-1) | 0.20 |
| Sixth Layer: Ultraviolet Light Absorbing Layer | |
| Gelatin | 0.54 |
| Ultraviolet light absorber (ratio of Cpd-6/Cpd-8/Cpd-10 = 1/5/3 by weight) | 0.21 |
| Solvent (Solv-4) | 0.08 |
| Seventh Layer: Protective Layer | |
| Gelatin | 1.33 |
| Acrylic-modified copolymer of polyvinyl alcohol (degree of modification of 17%) | 0.17 |
| Liquid paraffin | 0.03 |

There were used Cpd-12 and Cpd-13 as irradiation-inhibiting dyes. Alkanol XC (DuPont), sodium alkylbenzenesulfonate, succinic ester and Magafac F-120 (Dainippon Ink & Chemicals Inc.) were used as emulsion dispersants and coating aids. Further, Cpd-14 and Cpd-15 were used as stabilizers for silver halide.

The emulsions used had the following properties.

| Emulsion | Shape | Grain Size | Br Content (mol %) | Coefficient of Variation |
|---|---|---|---|---|
| EM7 | cube | 1.0 | 1.0 | 0.10 |
| EM8 | cube | 0.8 | 1.0 | 0.10 |
| EM9 | cube | 0.45 | 1.5 | 0.09 |
| EM10 | cube | 0.34 | 1.5 | 0.09 |
| EM11 | cube | 0.45 | 1.5 | 0.09 |

-continued

| Emulsion | Shape | Grain Size | Br Content (mol %) | Coefficient of Variation |
|---|---|---|---|---|
| EM12 | cube | 0.34 | 1.6 | 0.10 |

Coefficient of variation = standard deviation/average size

The following compounds were used for the abovedescribed layers.

ExM-1

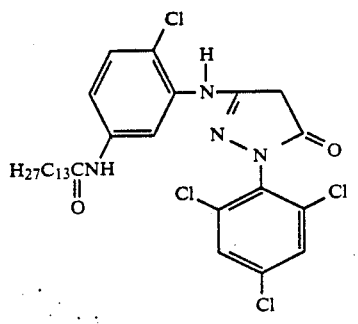

ExC-1

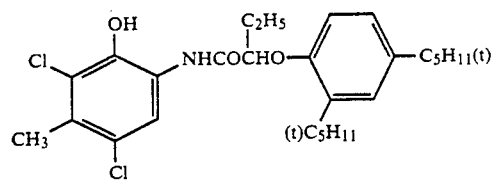

ExC-2

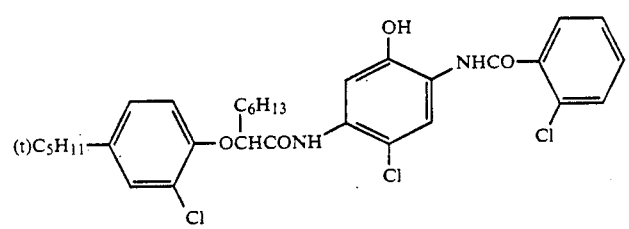

Cpd-2

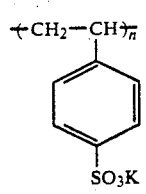

Cpd-3

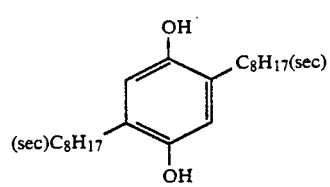

Cpd-4

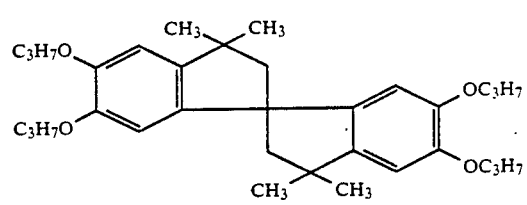

-continued
Cpd-5
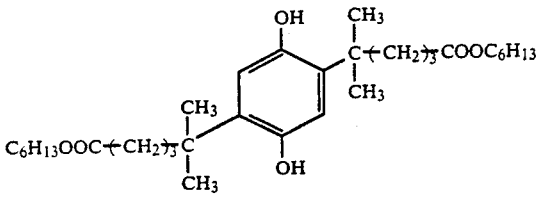
ExS-1
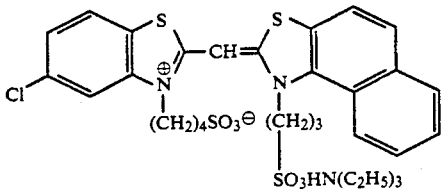
$6 \times 10^{-4}$ mol/mol of Ag
ExS-2
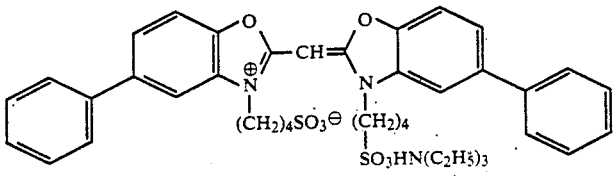
$4 \times 10^{-4}$ mol/mol of Ag
ExS-3
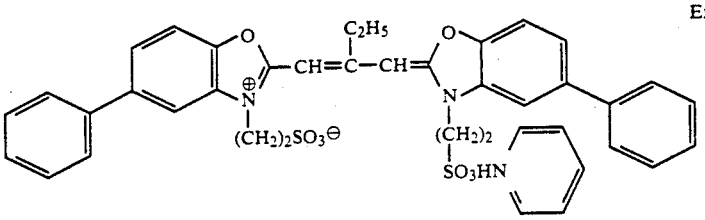
$8 \times 10^{-5}$ mol/mol of Ag
ExS-4
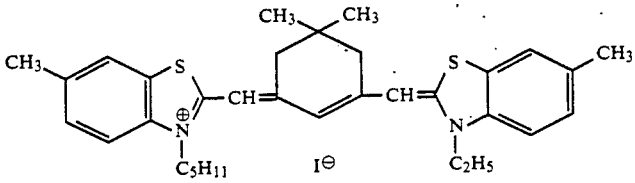
$1.8 \times 10^{-4}$ mol/mol of Ag
ExS-5
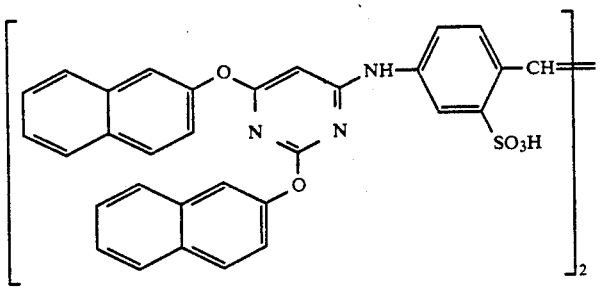
Cpd-6
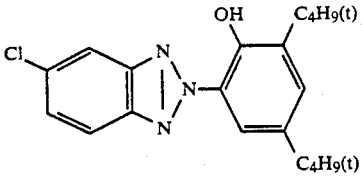

-continued
Cpd-7
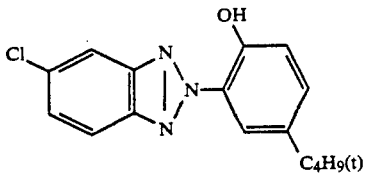
Cpd-8
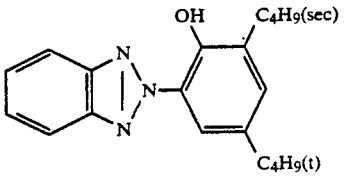
Cpd-9
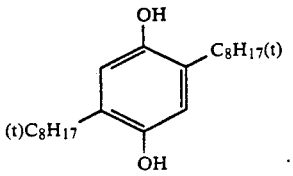
Cpd-10
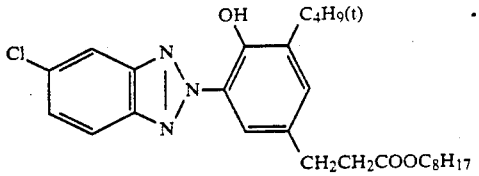
Cpd-11
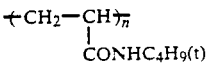
(n = 100~1000)
Average molecular weight = 100,000
Cpd-12
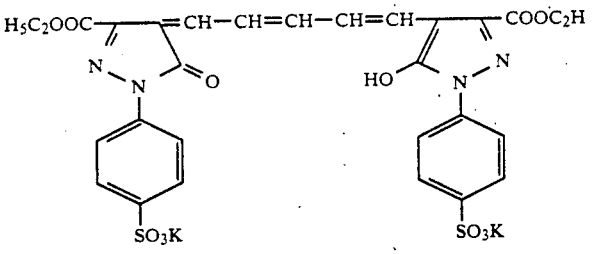
Cpd-13
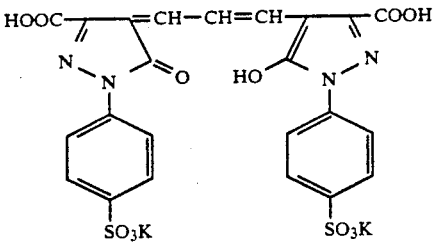
Cpd-14
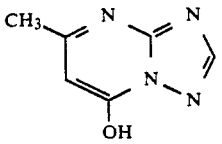

-continued

Cpd-15

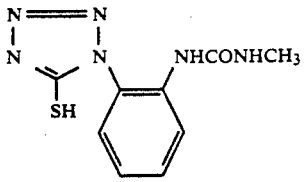

Dibutyl phthalate — Solv-1
Trioctyl phosphate — Solv-2
Trinonyl phosphate — Solv-3
Tricresyl phosphate — Solv-4

The procedure of the preparation of the above photographic material A was repeated except that equimolar amounts of couplers given in Table 2 were used in place of yellow coupler in the first layer of the photographic material, or further 50 mol% (based on the amount of coupler) of compounds having the formula (A-I) according to the present invention were added to prepare photographic materials B to J.

The photographic materials were exposed through optical wedge and then processed in the following stages.

| Processing Stage | Temperature | Time |
|---|---|---|
| Color development | 35° C. | 45 sec. |
| Bleach-fixing | 30–36° C. | 45 sec. |
| Stabilization (1) | 30–37° C. | 20 sec. |
| Stabilization (2) | 30–37° C. | 20 sec. |
| Stabilization (3) | 30–37° C. | 20 sec. |
| Stabilization (4) | 30–37° C. | 30 sec. |
| Drying | 70–85° C. | 60 sec. |

(Four tank countercurrent system from stabilization (4) to stabilization (1).

Each processing solution had the following composition.

| Color Developing Solution | |
|---|---|
| Water | 800 ml |
| Ethylenediaminetetraacetic acid | 2.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| 5,6-Dihydroxybenzene-1,2,4-trisulfonic acid | 0.3 g |
| Brightening agent (4,4'-diaminostilbene) | 2.0 g |
| Water to make up to | 1000 ml |
| pH (25° C.) | 10.10 |
| Bleach-Fixing Solution | |
| Water | 400 ml |
| Ammonium thiosulfate (70%) | 100 ml |
| Sodium sulfite | 18 g |
| Ammonium ethylenediamine-tetraacetato ferrate | 55 g |
| Disodium ethylenediaminetetraacetate | 3 g |
| Glacial acetic acid | 8 g |
| Water to make up to | 1000 ml |
| pH (25° C.) | 5.5 |
| Stabilizing Solution | |
| Formalin (37%) | 0.1 g |
| Formalin-sulfurous acid adduct | 0.7 g |
| 5-Chloro-2-methyl-4-isothiazoline-3-one | 0.02 g |
| 2-Methyl-4-isothiazoine-3-one | 0.01 g |
| Copper sulfate | 0.005 g |
| Water to make up to | 1000 ml |
| pH (25° C.) | 4.0 |

After processing, evaluation on photographic characteristics was made in a similar manner to that described in Example 1. Results are shown in Table 2-1.

It is apparent from Table 2-1 that the photographic materials of the present invention have high color formability as well as good image fastness.

TABLE 2-1

| Photographic Material | Yellow Coupler | Compound of Formula (A-I) of Invention | Photographic Characteristics $D_{min}$ | $D_{max}$ | Fastness to Light (%) | Fastness to Moisture and Heat (%) | Remarks |
|---|---|---|---|---|---|---|---|
| A | Y-7 | — | 0.11 | 2.16 | 60 | 62 | Comparative Ex. |
| B | R-1* | — | 0.12 | 1.70 | 52 | 50 | Comparative Ex. |
| C | R-1* | A-30 | 0.11 | 1.65 | 69 | 68 | Comparative Ex. |
| D | Y-7 | A-3 | 0.12 | 2.08 | 81 | 80 | Present Invention |
| E | Y-7 | A-5 | 0.12 | 2.09 | 77 | 78 | Present Invention |
| F | Y-7 | A-15 | 0.11 | 2.12 | 84 | 85 | Present Invention |
| G | Y-7 | A-31 | 0.11 | 2.15 | 81 | 83 | Present Invention |
| H | Y-7 | A-36 | 0.11 | 2.14 | 77 | 80 | Present Invention |
| I | Y-7 | A-39 | 0.11 | 2.13 | 78 | 78 | Present Invention |
| J | Y-7 | A-48 | 0.12 | 2.16 | 81 | 84 | Present Invention |

*Same as the comparative compound R-1 of Example 1.

After the photographic material A was imagewise exposed, continuous processing (running test) was conducted by using Figi color paper processor PP600 until the amount of replenisher reached twice as much as the capacity of tank for color development in the following processing stages.

| Processing Stage | Temperature (°C.) | Time (sec) | Replenishment Rate* (ml) | Capacity of Tank (l) |
|---|---|---|---|---|
| Color Development | 35 | 45 | 161 | 17 |
| Bleach-Fixing | 30–36 | 45 | 161 | 17 |
| Rinse (1) | 30–37 | 20 | — | 10 |
| Rinse (2) | 30–37 | 20 | — | 10 |
| Rinse (3) | 30–37 | 20 | — | 10 |

-continued

| Processing Stage | Temperature (°C.) | Time (sec) | Replenishment Rate* (ml) | Capacity of Tank (l) |
|---|---|---|---|---|
| Rinse (4) | 30–37 | 30 | 220 | 10 |
| Drying | 70–80 | 60 | | |

*per $m^2$ of photographic material.
(Four tank countercurrent system from Rinse (4) to Rinse (1).)

Each processing solution had the following composition.

| Color Developing Solution | Tank Solution | Replenisher |
|---|---|---|
| Water | 800 ml | 800 ml |
| Ethylenediamine-N,N,N',N'-tetramethylenephosphonic acid | 1.5 g | 1.5 g |
| Triethanolamine | 5.0 g | 5.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 4.2 g | 6.0 g |
| Brightening agent (4,4'-diaminostilbene) | 2.0 g | 2.5 g |
| Water to make up to | 1000 ml | 1000 ml |
| pH (25° C.) | 10.05 | 10.45 |

| Bleach-Fixing Solution | (tank solution and replenisher being the same) |
|---|---|
| Water | 400 ml |
| Ammonium thiosulfate (70%) | 100 ml |
| Sodium sulfite | 17 g |
| Ammonium ethylenediaminetetraacetato ferrate | 55 g |
| Disodium ethylenediaminetetraacetate | 5 g |
| Ammonium bromide | 40 g |
| Glacial acetic acid | 9 g |
| Water to make up to | 1000 ml |
| pH (25° C.) | 5.40 |

Rinsing Solution tank solution and replenisher being the same

Ion-exchanged water (content of each of calcium and magnesium being not higher than 3 ppm).

After the photographic materials A to J were exposed through optical wedge, they were processed by using the processing solutions used for said running test.

After processing, evaluation on photographic characteristics was made in the same way as in Example 1. The results are shown in Table 2-2.

It is apparent from Table 2-2 that the photographic materials of the present invention have high color formability as well as good image fastness even when the amounts of the rinsing replenisher are reduced in the processing of the photographic materials. Thus, it is clear that the present invention provides an effective image forming method.

TABLE 2-2

| Photographic Material | Yellow Coupler | Compound of Formula (A-1) of Invention | Photographic Characteristics Dmin | Dmax | Fastness to Light (%) | Fastness to Moisture and Heat (%) | Remarks |
|---|---|---|---|---|---|---|---|
| A | Y-7 | — | 0.13 | 2.15 | 48 | 53 | Comparative Ex. |
| B | R-1* | — | 0.14 | 1.71 | 52 | 40 | Comparative Ex. |
| C | R-1* | A-30 | 0.13 | 1.68 | 54 | 54 | Comparative Ex. |
| D | Y-7 | A-3 | 0.13 | 2.10 | 60 | 75 | Present Invention |
| E | Y-7 | A-5 | 0.14 | 2.08 | 72 | 73 | Present Invention |
| F | Y-7 | A-15 | 0.13 | 2.11 | 79 | 81 | Present Invention |
| G | Y-7 | A-31 | 0.14 | 2.13 | 76 | 78 | Present Invention |
| H | Y-7 | A-36 | 0.12 | 2.17 | 73 | 76 | Present Invention |
| I | Y-7 | A-39 | 0.13 | 2.10 | 75 | 75 | Present Invention |
| J | Y-7 | A-48 | 0.13 | 2.08 | 78 | 80 | Present Invention |

*Same as the comparative compound R-1 of Example 1.

EXAMPLE 3

The first layer (lowermost layer) to the seventh layer (uppermost layer) in order were coated on the surface of a corona discharge-processed paper support, onto both sides of which polyethylene was laminated, thus preparing a photographic material. Coating solution for each layer was prepared in the following manner. Couplers, color image stabilizers, etc. contained in the coating solutions are shown by structural formulae hereinafter.

The coating solution for the first layer was prepared in the following manner.

A mixture consisting of 200 g of yellow coupler, 93.3 g of a discoloration inhibitor, 10 g of a high-boiling solvent (p), 5 g of a solvent (q) and 600 ml of ethyl acetate as an auxiliary solvent was heated at 60° C. to dissolve them. The resulting solution was mixed with 3300 ml of a 5% aqueous solution of gelatin containing 330 ml of a 5% aqueous solution of Alkanol B (trade name, alkylnaphthalensulfonate, manufactured by Dupont). The mixture was emulsified by using a colloid mill to prepare a coupler dispersion. Ethyl acetate was removed from the dispersion by distilling off it under reduced pressure. The residue was added to 1400 g (containing 170 g of gelation; 96.7 g in terms of Ag) of an emulsion containing sensitizing dye for blue-sensitive emulsion layer and 1-methyl-2-mercapto-5-acetylamino-1,3,4-triazole. Further, 2600 g of a 10% aqueous solution of gelatin was added thereto to prepare a coating solution.

Each layer has a composition described below. Numerals represent coating weights ($mg/m^2$). Silver halide emulsions are expressed by coating weights in terms of silver.

Support

Paper support, onto both sides of which polyethylene was laminated.

| First Layer: Blue-Sensitive Layer | |
|---|---|
| Silver chlorobromide emulsion (silver bromide: 80 mol %) | 290 |
| Yellow coupler | 600 |
| Discoloration inhibitor (r) | 280 |
| Solvent (p) | 30 |
| Solvent (q) | 15 |
| Gelatin | 1800 |

-continued

| | |
|---|---|
| Second Layer: Antistain Layer | |
| Silver bromide emulsion (non-after ripening, grain size: 0.05 μm) in terms of silver | 10 |
| Antistain agent (s) | 55 |
| Solvent (p) | 30 |
| Solvent (q) | 15 |
| Gelatin | 800 |
| Third Layer: Green-Sensitive Layer | |
| Silver chlorobromide emulsion (silver bromide: 70 mol %) | 305 |
| Magenta coupler | 670 |
| Discoloration inhibitor (t) | 150 |
| Discoloration inhibitor (u) | 10 |
| Solvent (p) | 200 |
| Solvent (q) | 10 |
| Gelatin | 1400 |
| Fourth Layer: Antistain Layer | |
| Antistain agent (s) | 65 |
| Ultraviolet light absorber (n) | 450 |
| Ultraviolet light absorber (o) | 230 |
| Solvent (p) | 50 |
| Solvent (q) | 50 |
| Gelatin | 1700 |
| Fifth Layer: Red-Sensitive Layer | |
| Silver chlorobromide emulsion (silver bromide: 70 mol %) | 210 |
| Cyan coupler | 250 |
| Discoloration inhibitor (r) | 160 |
| Solvent (p) | 100 |
| Solvent (q) | 1800 |
| Gelatin | |
| Sixth Layer: Ultraviolet Light Absorbing Layer | |
| Ultraviolet light absorber (n) | 260 |
| Ultraviolet light absorber (o) | 70 |
| Solvent (p) | 300 |
| Solvent (q) | 100 |
| Gelatin | 700 |

-continued

| | |
|---|---|
| Seventh Layer: Protective Layer | |
| Gelatin | 620 |

(n) 2-(2-hydroxy-3,5-di-tert-amylphenyl)-benzotriazole
(o) 2-(2-hydroxy-3,5-di-tert-butylphenyl)-benzotriazole
(p) di(2-ethylhexyl) phthalate
(q) dibutyl phthalate
(r) 2,5-di-tert-amylphenyl-3,5-di-tert-butylhydroxybenzoate
(s) 2,5-di-tert-octylhydroquinone
(t) 1,4-di-tert-amyl-2,5-dioctyloxybenzene
(u) 2,2'-methylenebis-(4-methyl-6-tert-butylphenol)

The following sensitizing dyes for the emulsion layers were used.

Blue-sensitive emulsion layer:

Anhydro-5-methoxy-5'-methyl-3,3'-disulfopropylselenacyanine hydroxide

Green-sensitive emulsion layer:

anhydro-9-ethyl-5,5'-diphenyl-3,3'-di-sulfoethylloxacarbocyanine hydroxide

Red-sensitive emulsion layer:

3,3'-diethyl-5-methoxy-9,9'-(2,2'-dimethyl-1,3-propano)thiadicarbocyanine iodide The following compound was used as the stabilizer for each emulsion layer.

1-methyl-2-mercapto-5-acetylamino-1,3,4-triazole

The following compounds were used as the irradiation-inhibiting dyes.

4-(3-carboxy-5-hydroxy-4-(3-(3-carboxy-5-oxo-1-(4-sulfonatophenyl)-2-pyrazolie-4-ylidene)-1-propenyl)-1-pyrazolyl) benzenesulfonate dipotassium salt N,N'-(4,8-dihydroxy-9,10-dioxo-3,7-disulfonatoanthracene-1,5-diyl)bis(aminomethanesulfonate) tetrasodium salt Further, 1,2-bis(vinylsulfonyl)ethane was used as a hardening agent. The following couplers were used.

Yellow Coupler

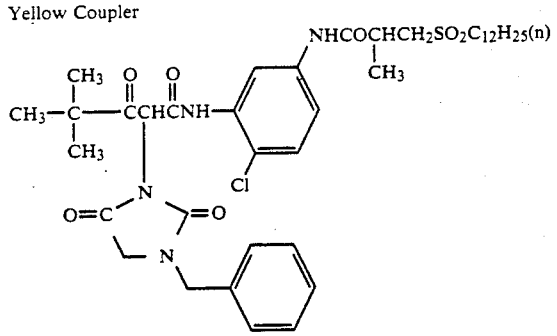

Magenta coupler

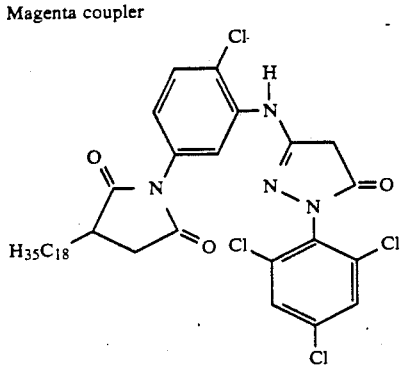

Cyan coupler

-continued

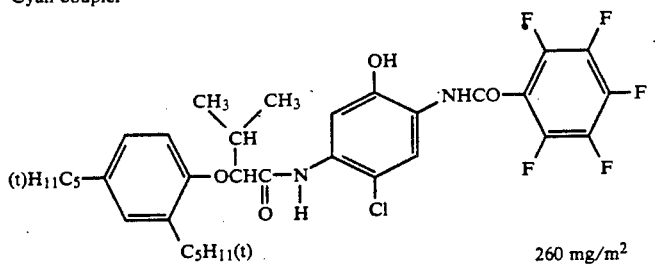

260 mg/m² and

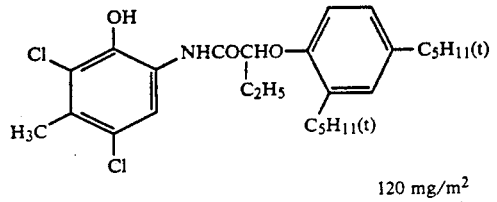

120 mg/m²
(molar ratio = 1:1)

Further, 30 mol % (based on the amount of coupler) of each of the compounds (A-7), (A-9), (A-28) and (A-53) of the present invention was added to the first layer of the above-described photographic material to prepare additional four photographic materials.

These materials were subjected to the following processing stages and evaluated in the same way as in Example 2. Similar effects to those of Example 2 could be obtained.

| Processing Stage | Temperature | Time |
|---|---|---|
| Color development | 38° C. | 100 sec. |
| Bleach-fixing | 35° C. | 60 sec. |
| Rinse (1) | 33–35° C. | 20 sec. |
| Rinse (2) | 33–35° C. | 20 sec. |
| Rinse (3) | 33–35° C. | 20 sec. |
| Drying | 70–80° C. | 50 sec. |

Each processing solution had the following composition.

| | Tank Solution |
|---|---|
| Color Developing Solution | |
| Water | 800 ml |
| Diethylenetriaminetetraacetic acid | 1.0 g |
| Nitrilotriacetic acid | 2.0 g |
| 1-Hydroxyethylidene-1,1-diphosphonic acid | 2.0 g |
| Benzyl alcohol | 16 ml |
| Diethylene glycol | 10 ml |
| Sodium sulfite | 2.0 g |
| Potassium bromide | 0.5 g |
| Potassium carbonate | 30 g |
| N-ethyl-N-(β-methanesulfonamidoethyl)-3-methyl-4-aminoaniline sulfate | 5.5 g |
| Hydroxylamine sulfate | 2.0 g |
| Brightening agent (Whitex 4, manufactured by Sumitomo Chemical Co., Ltd.) | 1.5 g |
| Water to make up to | 1000 ml |
| pH (25° C.) | 10.20 |

-continued

| | Tank Solution |
|---|---|
| Bleach-Fixing Solution | |
| Water | 400 ml |
| Ammonium thiosulfate (70%) | 80 ml |
| Ammonium sulfite | 24 g |
| Ammonium ethylenediamine-tetraacetato ferrate | 30 g |
| Disodium ethylenediaminetetraacetate | 5 g |
| Water to make up to | 1000 ml |
| pH (25° C.) | 6.50 |

Rinsing Solution

Ion-exchanged water (content of each of calcium and magnesium being not higher than 3 ppm).

REFERENTIAL EXAMPLE 1

In the same way as in Example 1, layers were provided on the surface of a paper support, onto both sides of which polyethylene was laminated, except that coating solutions were altered as follows: There was obtained a multi-layer silver halide photographic material 1-1 having the same layer structure as that of the photographic material A of Example 1.

Preparation of Coating Solution for the First Layer

In the preparation of the emulsified dispersion of the coupler, 4.4 g of color image stabilizer (Cpd-1) was added, and the coating weight of Cpd-1 was 0.19 g/m².

Third Layer

Color image stabilizers Cpd-5 (coating weight: 0.04 g/m²) and Cpd-6 (coating weight: 0.03 g/m²) were additionally used.

Fifth Layer

The compound A-7 (coating weight: 0.17 g/m²) was additionally used.

The following compound was used as ExM-1.

ExM-1

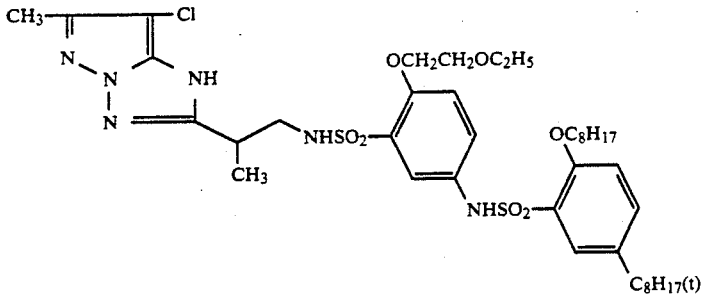

The compounds Cpd-1, Cpd-5 and Cpd-6 had the following structural formulae.

Cpd-1

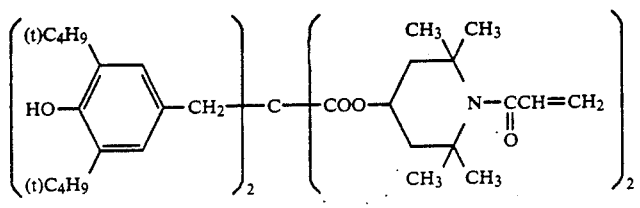

Cpd-5

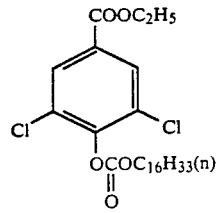

Cpd-6

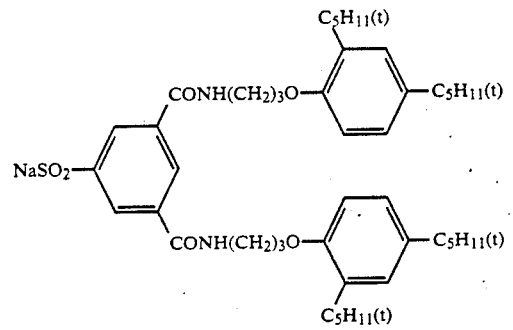

The procedure of the preparation of the photographic material 1-1 was repeated except that in the fifth layer of the material 1-1, cyan couplers, polymers for dispersion and compounds of the present invention given in Table 3 were used to prepare photographic materials 1-2 to 1-22.

The compound P-57 is the same as Cpd-11 used in Example 1 and the marks of the cyan couplers are as defined above.

TABLE 3

| Photographic Material | Cyan Coupler (0.72 mmol/m$^2$) | Polymer for Dispersion (0.10 g/m$^2$) | Compound of Invention (0.36 mmol/m$^2$) | Remarks |
|---|---|---|---|---|
| 1-1 | C-6 | P-57 | A-7 | Invention |
| 1-2 | " | " | A-8 | " |
| 1-3 | " | " | A-23 | " |
| 1-4 | " | " | A-27 | " |
| 1-5 | " | " | A-31 | " |
| 1-6 | " | " | A-43 | " |
| 1-7 | " | " | A-45 | " |
| 1-8 | " | " | A-56 | " |
| 1-9 | C-2 | " | A-7 | " |
| 1-10 | " | " | A-23 | " |
| 1-11 | C-2/C-3 = 1/1 | " | A-7 | " |
| 1-12 | C-5 | " | A-7 | " |
| 1-13 | " | " | A-23 | " |
| 1-14 | C-6 | P-57 | — | Comp. Ex. |
| 1-15 | " | — | A-7 | " |

TABLE 3-continued

| Photographic Material | Cyan Coupler (0.72 mmol/m²) | Polymer for Dispersion (0.10 g/m²) | Compound of Invention (0.36 mmol/m²) | Remarks |
|---|---|---|---|---|
| 1-16 | " | — | — | " |
| 1-17 | C-2 | P-57 | — | " |
| 1-18 | " | — | A-7 | " |
| 1-19 | " | — | — | " |
| 1-20 | C-5 | P-57 | — | " |
| 1-21 | " | — | A-7 | " |
| 1-22 | " | — | — | " |

After the photographic materials 1-1 to 1-22 were imagewise exposed, processing was conducted in the same was as in Example 1 (processing stages and formulations) except that the following bleach-fixing solution was used.

| Bleach-Fixinq Solution | Tank Solution |
|---|---|
| Water | 400 ml |
| Ammonium thiosulfate (70%) | 80 ml |
| Ammonium sulfite | 24 g |
| Ammonium ethylenediamine-tetraacetato ferrate | 30 g |
| Disodium ethylenediaminetetraacetate | 5 g |
| Water to make up to | 1000 ml |
| pH (25° C.) | 6.50 |

The processed samples were subjected to fastness test to heat and fastness test to moisture and heat. When the samples were left to stand in a dark place at 60° C. for 10 months and when the samples were left to stand in a dark place at 60° C. and RH of 70% for 6 months, the degree of fading was expressed by the ratio (percentage) of lowering in density from the initial density 1.5. The results are shown in Table 4.

It is apparent from Table 4 that fastness to heat and fastness to moisture and heat can be greatly improved, when the cyan couplers, the polymers for dispersion and the compounds according to the present invention are used.

TABLE 4

| Photographic Material | Fastness: at 60° C. for 10 months (%) | Fastness: at 60° C. and RH of 70% for 6 months (%) |
|---|---|---|
| 1-1 | 13 | 12 |
| 1-2 | 14 | 14 |
| 1-3 | 15 | 14 |
| 1-4 | 12 | 12 |
| 1-5 | 13 | 14 |
| 1-6 | 12 | 14 |
| 1-7 | 13 | 12 |
| 1-8 | 12 | 14 |
| 1-9 | 18 | 22 |
| 1-10 | 19 | 26 |
| 1-11 | 17 | 24 |
| 1-12 | 10 | 4 |
| 1-13 | 11 | 6 |
| 1-14 | 30 | 36 |
| 1-15 | 31 | 32 |
| 1-16 | 38 | 42 |
| 1-17 | 41 | 64 |
| 1-18 | 42 | 58 |
| 1-19 | 54 | 76 |
| 1-20 | 19 | 18 |
| 1-21 | 18 | 14 |
| 1-22 | 25 | 24 |

REFERENTIAL EXAMPLE 2

The procedure of the preparation of the photographic materials 1-1 and 1-14 of Referential Example 1 was repeated except that P-3, P-31, P-59, P-64, P-125, P-131 and P-160 as described below were used in place of the polymer P-57 for dispersion to prepare photographic materials 1-1-1 to 1-1-7 and 1-14-1 to 1-14-7. These photographic materials were processed in the same way as in Referential Example 1 and subjected to fastness test to heat and fastness test to moisture and heat. Similar results to those of Referential Example 1 were obtained.

P-3: poly(methylmethacrylate)
P-31: poly(ethylmethacrylate)
P-59: poly(cyclohexylmethacrylate)
P-64: poly(N-tert-butylmethacrylamide)
P-125: methylmethacrylate-styrene copolymer (90:10)
P-131: diacetoneacrylamide-methylmethacrylate copolymer (50:50)
P-160: tert-butylmethacrylate-methylmethacrylate copolymer (70:30)

REFERENTIAL EXAMPLE 3

In the same way as in Example 2, layers were provided on the surface of a paper support, onto both sides of which polyethylene was laminated, except that coating solutions were altered as follows: There was prepared a multi-layer silver halide photographic material 3-1 having the same layer structure as that of Example 2.

First Layer: Blue-Sensitive Layer

In the preparation of the emulsified dispersion of the coupler, 4.4 g of color image stabilizer (Cpd-1) was additionally used and the coating weight of Cpd-1 was 0.19 g/m².

Fifth Layer: Red-Sensitive Layer

The compound A-7 (coating weight: 0.14 g/m²) was additionally used and the coating weight of Cpd-11 was 0.07 g/m².

The compound Cpd-1 was the same as that of Referential Example 1.

As the solvent, a mixture (1:1 by volume) of

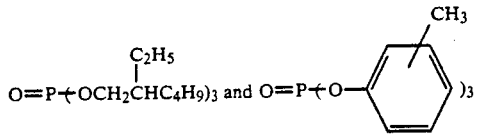

was used in place of Solv-2.

The procedure of the preparation of the photographic material 3-1 was repeated except that in the fifth layer, cyan couplers, polymers for dispersion and compounds of the present invention given in Table 5 were used to prepare photographic materials 3-2 to 3-14.

TABLE 5

| Photographic Material | Cyan Coupler (0.60 mmol/m²) | Polymer for Dispersion (0.10 g/m²) | Compound of Invention (0.30 mmol/m²) |
|---|---|---|---|
| 3-1 | C-2/C-10 = 1/1 | P-57 | A-7 |
| 3-2 | " | " | A-21 |
| 3-3 | " | " | A-42 |
| 3-4 | C-6 | " | A-7 |
| 3-5 | C-5 | " | " |
| 3-6 | C-2/C-10 = 1/1 | " | — |
| 3-7 | " | — | A-7 |
| 3-8 | " | — | — |
| 3-9 | C-6 | P-57 | — |
| 3-10 | " | — | A-7 |
| 3-11 | " | — | — |
| 3-12 | C-5 | P-57 | — |
| 3-13 | " | — | A-7 |
| 3-14 | " | — | — |

After the photographic materials 3-1 to 3-14 were exposed through optical wedge, they were processed in the same way as in Example 2 (the same processing stages and formulations).

The processed samples were subjected to fastness test to heat and fastness test to moisture and heat. When the samples were left to stand in a dark place at 60° C. for 10 months, and when the samples were left to stand in a dark place at 60° C. and RH of 70%, the degree of fading was expressed by the ratio of lowering in the density from the initial density 1.5. The results are shown in Table 6. It is apparent from Table 6 that fastness to heat and fastness to moisture and heat can be greatly improved, when the cyan couplers, the polymers for dispersion and the compounds of the invention are used.

TABLE 4

| Photographic Material | Fastness | |
|---|---|---|
| | at 60° C. for 10 months (%) | at 60° C. and RH of 70% for 6 months (%) |
| 3-1 | 7 | 4 |
| 3-2 | 8 | 5 |
| 3-3 | 8 | 4 |
| 3-4 | 10 | 4 |
| 3-5 | 9 | 4 |
| 3-6 | 18 | 14 |
| 3-7 | 16 | 14 |
| 3-8 | 22 | 25 |
| 3-9 | 18 | 18 |
| 3-10 | 20 | 16 |
| 3-11 | 25 | 28 |
| 3-12 | 17 | 19 |
| 3-13 | 18 | 17 |
| 3-14 | 27 | 26 |

When the yellow couplers having the formula (I) are used in combination with the compounds having the formula (A-I) according to the present invention, the color formability of the couplers and fastness of color image to light and moisture and hear can be improved. Further, high color formability as well as good image fastness can be obtained, even when the amounts of rinsing replenisher are reduced in the processing of the photographic materials.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material containing at least one yellow coupler represented by the following general formula (I) and at least one compound represented by the following general formula

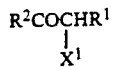

(I)

wherein $R^1$ represents a substituted or unsubstituted N-phenylcarbamoyl group; $R^2$ represents an alkyl group of an aryl group; $X^1$ represents a group represented by the following formula (a), (b), (c) or (d):

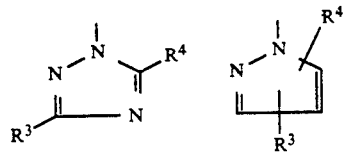

(a) (b)

wherein $R^3$ and $R^4$, which may be the same or different, each is a hydrogen atom, a halogen atom, a carboxylic acid ester group, an amino group, an alkyl group, an alkylthio group, an alkoxy group, an alkylsulfonyl group, an alkylsulfinyl group, a carboxyl group, a sulfonic acid group or a salt thereof, a substituted or unsubstituted phenyl group or a heterocyclic ring, (c)

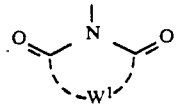

wherein $W^1$ represents a non-metallic atom required for forming a four-membered, five-membered or six-membered ring together with the moiety

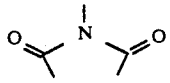

in the formula (c), (d)

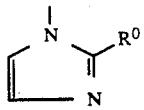

wherein $R^0$ represents an N-arylcarbamoyl group, (A-I)

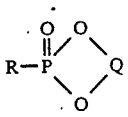

wherein R represents $—(Y)_n—R'$; Y represents —O—, —S—, —NH— or

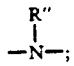

n is 0 or 1; R′ and R″, which may be the same or different, each represents an alkyl group, an alkenyl group, a cycloalkyl group, an aryl group, a heterocyclic group or an acyl group; and Q represents a divalent group of the following formula (A-I-1):

(A-I-1)

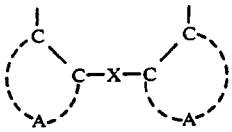

wherein A represents an atomic group which forms a substituted or unsubstituted benzene ring; X represents a single bond, a substituted or unsubstituted methylene group, —S—, —O—, —NH—,

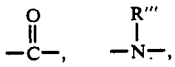

$—SO_2—$ —SO—; R‴ represents a hydrogen atom, an alkyl group, an alkenyl group, a cycloalkyl group, an aryl group, a heterocyclic group, an acyl group or a sulfonyl group; and the free bonds in the formula (A-I-1) represent the bonding positions to O atoms at the position of Q in the formula (A-I).

2. A silver halide color photographic material as claimed in claim 1, wherein $R^2$ represents a tertiary alkyl group having from 4 to 20 carbon atoms.

3. A silver halide color photographic material as claimed in claim 1, wherein said yellow couplers are represented by the following general formula (I′):

(I′)

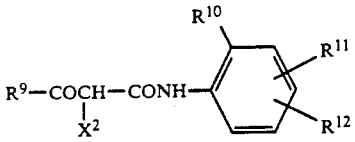

wherein $R^9$ is a tertiary alkyl group having from 4 to 12 carbon atoms, or a phenyl group which may be substituted by a halogen atom, an alkyl group or an alkoxy group; $R^{10}$ is a halogen atom or an alkoxy group; $R^{11}$ is a hydrogen atom, a halogen atom or an alkoxy group which may be optionally substituted; $R^{12}$ is an acylamino group which may be optionally substituted, an alkoxycarbonyl group, an alkylsulfamoyl group, an acylsulfamoyl group, an arylsulfamoyl group, an alkylsulfonamido group, an arylsulfonamido group, an alkylureido group, an arylureido group, a succinimido group, an alkoxy group or an aryloxy group; and $X^2$ is a group represented by the following general formula (e), (f), (g) or (h):

(e)

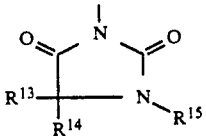

-continued (f)

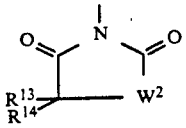

(g)

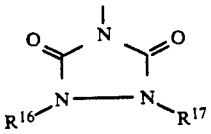

(h)

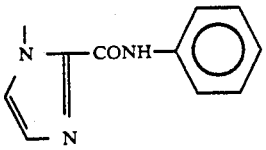

wherein $R^{13}$ and $R^{14}$ each is a hydrogen atom, an alkyl group, an aryl group, an alkoxy group, an aryloxy group or a hydroxyl group; $R^{15}$, $R^{16}$ and $R^{17}$ each is a hydrogen atom, an alkyl group, an aryl group, an aralkyl group or an acyl group; and $W^2$ is an oxygen atom or a sulfur atom.

4. A silver halide color photographic material as claimed in claim 3, wherein said yellow couplers are represented by the following general formula (I″):

(I″)

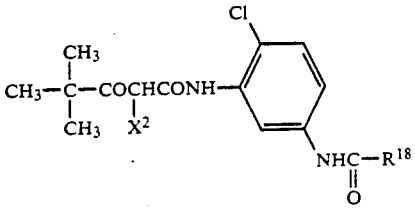

wherein $R^{18}$ is a substituted or unsubstituted alkyl group or phenyl group; and $X^2$ is the group represented by the formula (e), (f) or (g) as set forth in the formula (I′).

5. A silver halide color photographic material as claimed in claim 1, wherein n is 0 or 1 and Y represents —O—.

6. A silver halide color photographic material as claimed in claim 1, wherein Q represents a divalent group of the following formula (A-I-2):

(A-I-2)

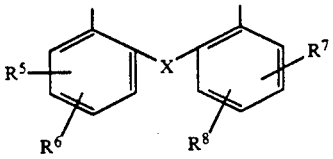

wherein free bonds and X are the same as those set forth in the formula (A-I-1); and $R^5$, $R^6$, $R^7$ and $R^8$ each is a hydrogen atom or a substituent group.

7. A silver halide color photographic material as claimed in claim 6, wherein said substituent group of $R^5$, $R^6$ or $R^7$ is an aliphatic group, an aromatic group, a heterocyclic ring, a halogen atom, an aliphatic oxy group, an acyloxy group, a sulfonyloxy group, an acylamino group, a sulfonamido group, an amino group, an aliphatic or aromatic oxycarbonyl group, a carbamoyl group or a hydroxy group.

8. A silver halide color photographic material as claimed in claim 6, wherein X is a substituted or unsubstituted methylene group, an acyl bond, an oxygen atom, a sulfur atom, a sulfonyl bond or an amono group.

9. A silver halide color photographic material as claimed in claim 1, wherein said yellow coupler and said compound of formula (A-I) are added to the same silver halide emulsion layer.

10. A silver halide color photographic material as claimed in claim 9, wherein said yellow coupler is added to emulsion layer in an amount of $1\times10^{-3}$ to 1 mol per mol of silver halide existing in the same layer.

11. A silver halide color photographic material as claimed in claim 10, wherein said yellow coupler is added to emulsion layer in an amount of $5\times10^{-2}$ to $5\times10^{-1}$ mol per mol of silver halide existing in the same layer.

12. A silver halide color photographic material as claimed in claim 9, wherein said compound of formula (A-I) is added to emulsion laye in an amount of 1 to 200 mol % based on the yellow coupler.

13. A silver halide color photographic material as claimed in claim 12, wherein said compound is added to emulsion layer in an amount of 2 to 30 mol % based on the yellow coupler.

14. A silver halide color photographic material as claimed in claim 9, wherein said silver halide emulsion layer contains a silver halide having the average content of silver chloride of not less than 2 mol %.

15. A silver halide color photographic material as claimed in claim 14, wherein said silver halide is a silver chloride or a silver chlorobromide having the average content of silver chloride of not less than 90 mol %.

16. A silver halide color photographic material as claimed in claim 15, wherein said silver halide is a silver chlorobromide having the average content of silver chloride of from 98 to 99.9 mol %.

17. A silver halide color photographic material as claimed in claim 14, wherein the silver halide emulsion in said silver halide emulsion layer is a monodisperse emulsion having the coefficient of variation of the grain size distribution of not higher than 20%.

18. A silver halide color photographic material as claimed in claim 17, wherein said silver halide emulsion is a monodisperse emulsion having the coefficient of variation of the grain size distribution of not higher than 15%.

19. A silver halide color photographic material as claimed in claim 1, wherein said yellow coupler and said compound of formula (A-I) are dissolved in or impregnated with lipophilic fine particles.

* * * * *